US005881779A

United States Patent [19]

Kountz et al.

[11] Patent Number: 5,881,779

[45] Date of Patent: Mar. 16, 1999

[54] COMPUTER READABLE MEDIUM CONTAINING SOFTWARE FOR CONTROLLING AN AUTOMATED COMPRESSED GAS DISPENSING SYSTEM

[75] Inventors: Kenneth J. Kountz, Palatine; William E. Liss, Libertyville; Christopher F. Blazek, Palos Hills, all of Ill.

[73] Assignee: Gas Research Institute, Chicago, Ill.

[21] Appl. No.: 954,798

[22] Filed: Oct. 21, 1997

Related U.S. Application Data

[60] Division of Ser. No. 652,730, May 22, 1996, which is a continuation-in-part of Ser. No. 618,975, Mar. 20, 1996.

[51] Int. Cl.[6] ..... B65B 1/30

[52] U.S. Cl. ..... 141/83; 141/2; 141/3; 141/4; 141/21; 141/39; 141/95; 364/479.1; 73/149

[58] Field of Search ..... 141/2, 3, 4, 8, 141/21, 37, 39, 47, 48, 49, 51, 83, 94, 95, 98, 231; 364/479.1; 137/79, 80; 73/149

[56] References Cited

U.S. PATENT DOCUMENTS

| | | | |
|---|---|---|---|
| 4,010,623 | 3/1977 | Kaschak | 62/55 |
| 4,419,898 | 12/1983 | Zanker et al. | 73/861.02 |
| 4,527,600 | 7/1985 | Fisher et al. | 141/4 |
| 4,865,088 | 9/1989 | Stearns | 141/5 |
| 4,883,099 | 11/1989 | Vanommeren | 141/1 |
| 4,898,217 | 2/1990 | Corbo et al. | 141/83 |
| 4,966,206 | 10/1990 | Baumann et al. | 141/98 |
| 4,987,932 | 1/1991 | Pierson | 141/1 |
| 5,029,622 | 7/1991 | Mutter | 141/4 |
| 5,211,021 | 5/1993 | Pierson | 62/50.2 |
| 5,259,424 | 11/1993 | Miller et al. | 141/4 |
| 5,351,726 | 10/1994 | Diggins | 141/4 |
| 5,365,981 | 11/1994 | Peschka et al. | 141/7 |
| 5,373,702 | 12/1994 | Kalet et al. | 62/50.2 |
| 5,385,176 | 1/1995 | Price | 141/1 |
| 5,406,988 | 4/1995 | Hopkins | 141/2 |
| 5,409,046 | 4/1995 | Swenson et al. | 141/11 |
| 5,411,374 | 5/1995 | Gram | 417/53 |
| 5,431,203 | 7/1995 | Schultz et al. | 141/197 |
| 5,465,583 | 11/1995 | Goode | 62/50.2 |
| 5,628,349 | 5/1997 | Diggins et al. | 141/3 |

*Primary Examiner*—David J. Walczak
*Assistant Examiner*—Timothy L. Maust
*Attorney, Agent, or Firm*—Thomas, Kayden, Horstemeyer & Risley, L.L.P.

[57] ABSTRACT

A method and apparatus for dispensing compressed natural gas and for maximizing the mass of compressed gas dispensed into a gas storage cylinder is disclosed. Pressure and temperature transducers are provided as a part of the apparatus to emit data signals to a control processor of the pressure and temperature of a supply of compressed gas delivered to a gas dispenser, as well as the ambient temperature at the dispenser and the pressure of the compressed gas within the cylinder, respectively. A mass flow meter is also provided for emitting a data signal to the control processor of the mass of compressed gas injected into the storage cylinder. The control processor includes a dispenser control program which processes the emitted data signals to automatically maximize the mass of compressed gas injected into the cylinder by performing at least a two-stage fill process for computing at least two dynamic estimates of the storage cylinder volume during the gas dispensing process, and for determining the maximum mass of compressed gas that can be safely injected into the gas storage cylinder in response thereto. Additional fill stages may be performed in order to calculate additional estimates of the storage cylinder volume in the control processor, if so desired, for even more accurately determining the mass of compressed gas that may be injected into the cylinder for maximizing the gas injection into the gas storage cylinder.

28 Claims, 14 Drawing Sheets

COMPUTER READABLE MEDIUM CONTAINING SOFTWARE FOR CONTROLLING AN AUTOMATED COMPRESSED GAS DISPENSING SYSTEM

CROSS-REFERENCE TO RELATED APPLICATION

This application is a divisional of patent application Ser. No. 08/652,730 filed in the United States Patent and Trademark Office on May 22, 1996, which in turn is a continuation-in-part of patent application Ser. No. 08/618,975, filed on Mar. 20, 1996 entitled "Method and Apparatus for Dispensing Compressed Natural Gas."

FIELD OF THE INVENTION

This invention relates in general to systems for dispensing of compressed gases. More particularly, this invention relates to a method and apparatus for dispensing compressed natural gas from a dispenser which safely maximizes the mass of compressed natural gas injected into the gas storage cylinder without exceeding the gas density rating and/or maximum design pressure of the gas storage cylinder.

BACKGROUND OF THE INVENTION

As efforts are made to reduce motor vehicle exhaust emissions and to reduce air pollution, automobile manufacturers have turned toward the development of alternate fuel sources for motor vehicles. One of these fuel sources is compressed natural gas ("CNG"), an abundant, relatively inexpensive, and clean burning fuel. However, and unlike conventional hydrocarbon motor fuels, for example gasoline, compressed natural gas cannot be poured or dispensed as simply as hydrocarbon fuels may be, rather compressed natural gas is typically injected under pressure into a compressed natural gas vehicle cylinder.

As with gasoline powered vehicles, the on board storage capacity of the compressed natural gas vehicle cylinder, also referred to as the "cylinder", defines the maximum driving range of the motor vehicle before refueling is required. The underfilling of compressed natural gas vehicle cylinders, especially during fast fill charging operations, i.e., those taking less than five minutes, can occur at fueling stations having dispensers which are incorrectly or inaccurately compensated for initial cylinder and station supply gas pressures, as well as the supply gas temperature(s), the ambient temperature, and the dynamic fill conditions at the dispenser. At higher ambient temperature conditions, for example, those which exceed the "standard temperature" of 70 degrees fahrenheit, and under direct station compressor outlet charging of the cylinder, the underfilling of the cylinder can reach 20% or more of its rated gas mass storage capacity. This underfilling is a serious obstacle the natural gas industry must overcome in order to make compressed natural gas powered motor vehicles more acceptable by maximizing the driving range between cylinder fills. Moreover, this underfilling must be resolved without resorting to unnecessarily high fueling station gas storage pressures, or by extensively overpressurizing the cylinder during the fueling operation which may result in dangerous cylinder load conditions, and/or result in the venting of overpressurized compressed natural gas into the ambient air surrounding a motor vehicle, with the accompanying hazards of explosion or fire.

A primary cause of undercharging cylinders during fast fill operations is a result of fueling station dispensers which either ignore, or inaccurately estimate, the elevated compressed natural gas cylinder gas temperatures which occur in the charging process due to the compression, mixing, and other complex, transient, and dynamic thermodynamic processes, i.e., the conversion of gas enthalpy to temperature changes, resulting from the injection of compressed natural gas into a cylinder of generally unknown volume. This is shown graphically in FIG. 1, where the vehicle cylinder temperature is shown as a function of the change in injected gas mass for two cylinder volumes of 500 s.c.f. and 2,000 s.c.f., respectively, and at two initial cylinder gas pressures, 100 psi and 1500 psi, for each cylinder. As shown, if a cylinder is relatively full of gas when gas mass injection is started, shown by the 1,500 psi pressure lines, cylinder temperature rises in a generally linear manner which can be predicted to some degree. However, if initial cylinder pressure, and thus volume, is low cylinder temperatures change in a more unpredictable fashion making full cylinder fills difficult to determine. Another aspect of cylinder underfill problems is shown in FIG. 2, wherein three pairs of representative test data are shown, each pair starting at the same pressure and temperature in the cylinder. In FIG. 2 the temperatures shown in parentheses represents the average supply gas temperature over the fill process. Thus the importance of being able to accurately account for the supply conditions prior to and during the charging of the cylinder is shown by the differing endpoint gas temperatures and gas storage cylinder pressures resulting for each test pair due to only a difference in supply gas temperatures. This again demonstrates the dynamic nature of the compressed natural gas fill process. Yet another reason for the undercharging of cylinders is that the industry has not adopted a standard size cylinder for use in motor vehicles, and in some instances standard size cylinders cannot be used based due to the size of the motor vehicle as well as its intended load carrying capacity. This results in inaccuracies in the charging/fill process from the inability to accurately determine the volume of the cylinder, and thus the mass of compressed gas which can be injected into the cylinder to maximize the gas mass during the charging process.

As is known, during the charging or injection of compressed natural gas into a cylinder, the expansion of the gas in flowing from a station ground storage reservoir, or directly from a station compressor outlet, for example, tends generally to reduce the temperature of the compressed natural gas entering the cylinder due to the Joule-Thomson effect which occurs during this essentially constant enthalpy process, see FIG. 1. However, as the compressed natural gas enters the cylinder, the enthalpy of the gas is converted into internal energy, which equates to increases in internal cylinder gas temperature. The temperature range which results from this conversion of the compressed gas enthalpy into internal energy is a function not only of the size of the cylinder, however, but also of the pressure and temperature of the compressed gas being injected into the cylinder, as well as the pressure of the gas already in the cylinder prior to the injection of additional compressed natural gas, and the ambient temperature conditions at the dispenser. Thus, as the enthalpy of the compressed natural gas entering the cylinder is converted into internal energy within the cylinder, the gas undergoes complex and dynamic compression and mixing processes which typically overcome the cooling effect of the compressed natural gas being injected into the cylinder, resulting in increased cylinder temperatures which do not generally allow for to an accurate and complete injection of a "full" gas mass into the cylinder.

Most charging processes in the art are typically terminated when the fueling station dispenser measures, or estimates, the point of which the natural gas storage vehicle cylinder reaches a certain pressure level. Depending on the dispenser control system used, this level of cylinder cut-off pressure may have some dependence on ambient or station gas conditions, but typically fails to take into account the impact of the enthalpy to internal energy conversion which occurs during the fill process as it impacts cylinder pressures and temperatures. This will oftentimes result in an inaccurate or incomplete cylinder fill, which is especially problematic during fast fill charging operations. Although this problem may be lessened to some degree during a more protracted fill process, the expectations of consumers are that they will be able to fuel their motor vehicles quickly, efficiently, and safely in a fill process which will typically takes less than five minutes.

An example of a dispenser control system which employs a pre-calculated cutoff pressure scheme is the method and apparatus for dispensing compressed natural gas disclosed in U.S. Pat. No. 5,259,424 to Miller et al., issued Nov. 9, 1993. The control system of Miller et al calculates a vehicle tank cut-off pressure based on the ambient air temperature at the dispenser and the pre-programmed pressure rating of the vehicle cylinder stored in the control system. Miller et al. then calculate the volume of the vehicle tank and an additional mass of compressed natural gas required to increase the tank pressure to the cut-off pressure, whereupon the dispenser automatically turns off the compressed natural gas flow into the vehicle cylinder once the additional mass necessary to obtain the pre-calculated cut-off pressure has been injected into the cylinder. Although Miller at al. teach a method and apparatus which predetermines an amount of compressed natural gas, i.e., a gas mass, for injection into the gas cylinder, the mass of gas to be injected is based upon an estimated cut-off pressure within the vehicle cylinder, and is thus not a true mass based system which seeks to maximize the amount of gas mass injected into the cylinder, so long as the pressure limit of the cylinder is not exceeded.

Thus, and for the reasons discussed above, the temperatures that compressed natural gas vehicle cylinders reach at the end of dynamic fill or charging processes have been difficult to accurately predict in the known dispenser fill and control methodology. Thus, what is needed, but seemingly not available in the art, is a method and apparatus for dispensing compressed natural gas which compensates for the increase in cylinder gas temperatures during the charging process, and which also takes into account initial cylinder pressure and temperature conditions, as well as supply gas pressure and temperature conditions, in order to maximize the gas mass injected into a compressed natural gas vehicle cylinder for maximizing the driving range of a motor vehicle before the next fill process need be undertaken.

SUMMARY OF THE INVENTION

Briefly described, the present invention provides an improved method and apparatus for maximizing the mass of compressed natural gas injected into a natural gas vehicle storage cylinder which overcome some of the design deficiencies of other gas dispensing methods and apparatuses known in the art by taking into account the conversion of the compressed gas enthalpy into internal energy and the resulting increases in storage cylinder pressures and temperatures which result therefrom, as well as the dynamic fill conditions encountered during the dispensing or fill process. This new method and apparatus results in the safe, efficient, and complete gas mass injection of compressed natural gas into storage cylinders. This is accomplished through a multi-step fill process which includes the determination of cylinder volume identification at two or more steps during the charging process, and a closed loop control over the dispenser fill valve based on the measured gas mass injected into the cylinder. The method and apparatus of this invention correlate the measured gas storage cylinder pressure responses to the computed and measured masses of compressed gas injected into the storage cylinder in conjunction with predicted pressure responses used to control over the steps of the fill process.

The fill process of our invention is well-suited for use at compressed gas dispensers having a supply of compressed gas, including, but not limited to natural gas, propane, butane, or other similar fuel gases. The dispenser will be provided with a pressure tight dispensing hose connected to a dispenser fill valve through which the compressed gas is injected into the gas cylinder, plus conventional detection sensors, for example transducers, for measuring the pressure and temperature of the compressed gas injected into the storage cylinder, the storage cylinder having a generally known initial pressurized fill state and a known limit pressure.

In our fill process, the dispensing hose is connected to the vehicle cylinder and a first mass of compressed gas is continuously injected into the cylinder and compared against a predetermined base gas mass entered into the control processor of the dispensing system correlating to a programmed pressure increase within the gas storage cylinder of approximately 250 psi, whereupon the first mass of compressed gas is measured and used with the temperature readings of the supply gas and of the gas injected into the storage cylinder in calculating a fist estimate of cylinder volume in response thereto. Thereafter, we estimate the amount of a second mass of compressed gas needed to fill the vehicle cylinder to a first predetermined fill state while also estimating a third mass of compressed gas needed to fill a reference cylinder, used as a model, to the first predetermined fill state in response thereto. The second mass of compressed gas is then injected into the vehicle cylinder. The total gas mass injected into the vehicle cylinder is measured from the initial cylinder fill/mass state, and the pressure of the compressed gas within the cylinder resulting from the injection of this second mass of compressed gas therein is also measured. A second estimate of the vehicle cylinder volume is then made for greater accuracy in completing the fill process.

Thereafter, our improved process for filling compressed gas cylinders can be completed by computing a fourth mass of compressed gas that will result in a compressed gas pressure within the reference cylinder, from its initial cylinder state, which equals the measured pressure of the compressed gas within the vehicle cylinder after the second gas mass has been injected therein, computing a fifth mass of compressed gas to be injected into the vehicle cylinder for attaining a final fill state in response thereto, and then injecting the fifth mass of compressed gas into the vehicle cylinder to complete the fill process.

In the alternative, however, when a more accurate determination of the volume, and thus gas mass to be injected into a cylinder is desired, our automatic fill process, and the apparatus which practices this process, estimates a fourth mass of compressed gas required to fill the vehicle cylinder to a second intermediate fill state, estimates a fifth mass of compressed gas required to fill the reference cylinder to the second intermediate fill state, injects the fourth mass of compressed gas into the vehicle cylinder, and then calculates a third volume estimate of the cylinder in response thereto. Thereafter, the fill process is completed by computing a sixth mass of compressed gas that will result in a gas pressure within the reference cylinder, from its initial state, which equals the measured pressure of the compressed gas within the vehicle cylinder after the fourth mass has been injected, then computing a seventh mass of compressed gas to be injected into the vehicle cylinder for attaining a final fill state in response thereto, followed by injecting the seventh (final) mass of compressed gas into the vehicle cylinder.

Our compressed gas dispensing system which practices the above described process includes a control processor; a pressure transducer and a temperature transducer for measuring the pressure and temperature of the supply gas in a supply gas plenum, each of which signals temperature and pressure data signals thereof to the control processor, respectively; a second pressure transducer measuring the pressure of the compressed gas within the gas cylinder; a second air temperature transducer for measuring the ambient air temperature at the dispenser; a compressed natural gas dispenser; a mass flow meter in the dispenser in sealed fluid communication with the supply plenum, the mass flow meter signaling the measured mass of compressed gas injected into the gas container to the control processor; a solenoid fill valve actuated by signals received from the control processor, and emitting a feed-back signal to the control processor for the operation of the solenoid fill valve; and a computer program stored within the control processor for controlling the dispensing of compressed gas from the dispenser.

The computer program held within the control processor is stored in or on a computer readable medium, and includes mechanisms for performing the method described in greater detail, above.

Thus, it is an object of invention to provide an improved method and apparatus of dispensing compressed natural gas which maximizes the mass of compressed gas injected into a compressed natural gas cylinder during a fast fill charging operation.

An additional object of our invention is to provide an improved method and apparatus of dispensing compressed natural gas which provides a mass based fill system for filling compressed natural gas storage cylinders to their rated gas mass capacity.

Yet another object of the invention is to provide an improved method and apparatus for dispensing compressed natural gas which compensates for the internal energy in the compressed gas and for the dynamic fill conditions of the fill process during fast fill charging operations.

Still another object of the invention is to provide an improved method and apparatus for dispensing compressed natural gas which provides an accurate means of determining the storage volume of a compressed natural gas storage cylinder.

It is also an object of the invention is to provide an improved method and apparatus for dispensing compressed natural gas which accurately predicts the gas pressure and temperature conditions within a compressed natural gas cylinder after the injection of a known gas mass.

An additional object of the invention is to provide an improved method and apparatus for dispensing compressed natural gas which determines the required quantity of gas mass for injection into a compressed natural gas cylinder that will not exceed either the gas mass density or maximum gas pressure limits of the gas storage cylinder.

Still another object of our invention is to provide an improved method and apparatus of dispensing compressed natural gas which completely and safely fills a compressed natural gas cylinder, regardless of fill conditions, and regardless of cylinder service ratings or service pressures, to its rated gas mass capacity.

It is also an object of the invention to provide an improved method and apparatus of dispensing compressed natural gas and of filling compressed natural gas cylinders which is simple in operation and design, is inexpensive to operate and construct, and is durable and rugged in structure.

Thus, these and other objects, features, and advantages of the invention will become apparent upon reading the specification when taken in conjunction with the accompanying drawings, wherein like characters of reference designate corresponding parts throughout the several views.

DETAILED DESCRIPTION

Figure 4:
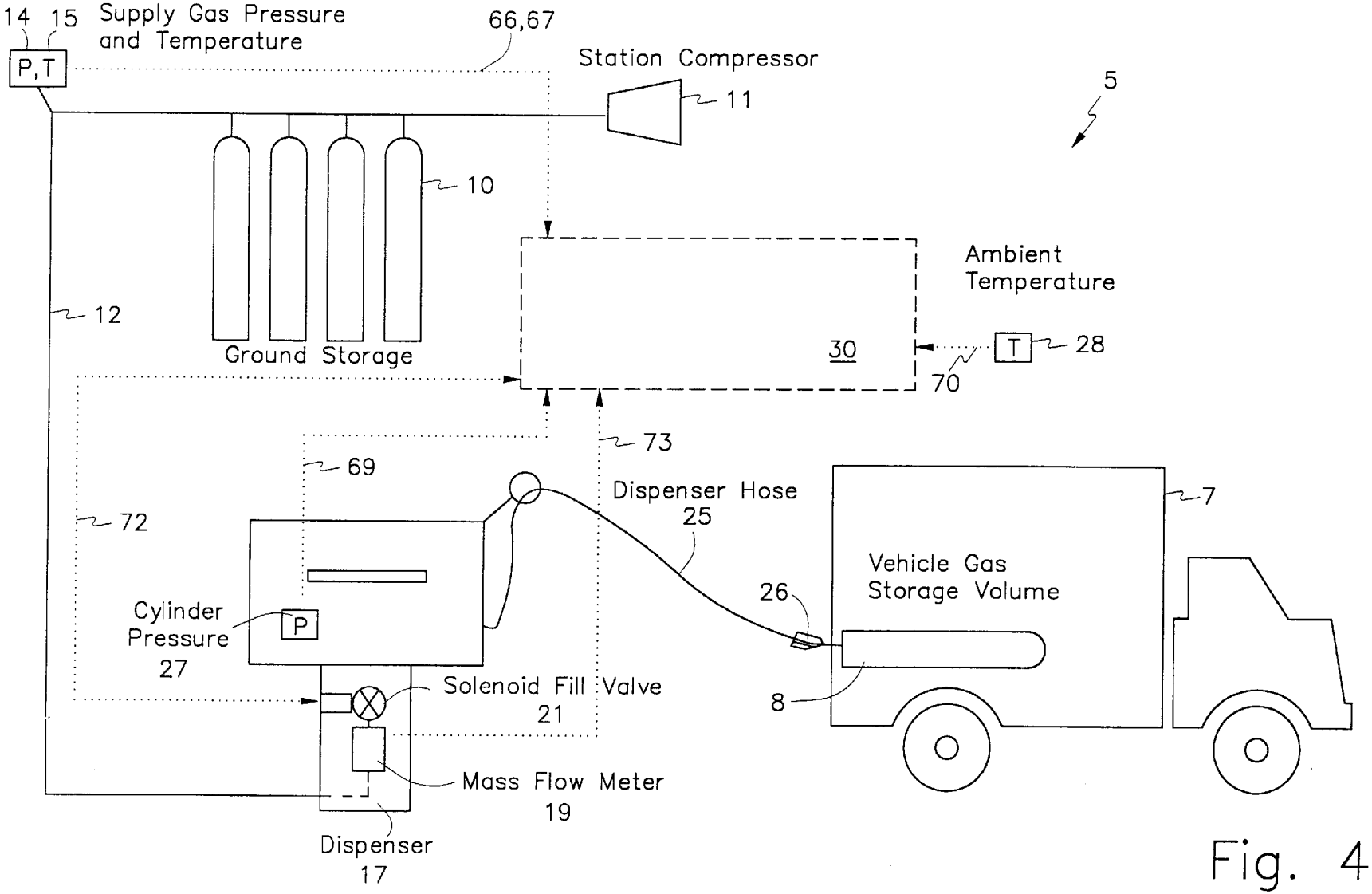
FIG. 4 is a schematic illustration of a preferred embodiment of the dispensing system of this invention.

Referring now in detail of the drawings, in which like reference numerals represent like parts through the several views, numeral 5 of FIG. 4 illustrates a preferred embodiment of our compressed natural gas dispensing system. Although natural gas dispensing system 5 is shown for use with natural gas, it is understood by those skilled in the art that natural gas dispensing system 5, as well as the method of automatically filling gas containers, can be used with any compressible fluid medium having a gaseous end-state.

Natural gas dispensing system 5 is shown here supplying compressed natural gas to a motor vehicle 7 having a natural gas vehicle cylinder 8 formed as a part thereof. The apparatus illustrated in FIGS. 4 and 5, as well as the processes illustrated in FIGS. 6A through 6I, are particularly well-suited for use in applications where the volume of gas cylinder 8 is unknown and gas cylinder 8 is to be injected with compressed natural gas in a fast fill charging operation. It is understood by those skilled in the art that a fast fill charging operation is one which generally takes five minutes or less in order to fully inject the allowable maximum gas mass within a gas cylinder before driving away from the dispenser.

Referring to FIG. 4, natural gas dispenser system 5 is provided with a supply of compressed gas 10, shown in an above-ground storage tank array 10. The natural gas is compressed by a station compressor 11 and passed through an otherwise conventional supply plenum 12, supply plenum 12 being provided with a pressure transducer 14 and a temperature transducer 15 for measuring the pressure and temperature, respectively, of the compressed natural gas being moved through supply plenum 12 toward dispenser 17. Supply plenum 12 is a conventional high pressure gas plenum constructed and arranged for use with high pressure fluids and/or gases, the supply plenum being generally fluid-tight and pressure-tight.

Dispenser 17 is provided with a mass flow meter 19 which measures the mass of the compressed gas dispensed into natural gas vehicle cylinder 8. Mass flow meter 19 is in sealed fluid communication with supply plenum 12. After passing through the mass flow meter, the compressed gas then passes through solenoid fill valve 21 into a pressure-tight dispensing hose 25 having a dispenser fill connector 26 in sealed fluid communication therewith. Connector 26 is sized and shaped to be received within a pressure-tight fill neck (not illustrated) formed as a part of vehicle 7 for channeling the compressed natural gas into cylinder 8. Dispenser 17 is also provided with a pressure transducer 27 in sealed fluid communication with the compressed gas line between solenoid fill valve 21 and dispensing hose 25. Pressure transducer 27 measures the pressure in cylinder 8 through dispensing hose 25. This is accomplished by placing connector 26 within the appropriate receptacle, for example an elongated fill neck (not illustrated) extending to the cylinder in motor vehicle 7, opening the connector, whereupon compressed gas from the cylinder will flow into hose 25 back to solenoid fill valve 21, the gas pressure in hose 25 then equaling the gas pressure in cylinder 8. The dispenser is also provided with an ambient temperature transducer 28 which measures the ambient air temperature at the dispenser.

Figure 5:
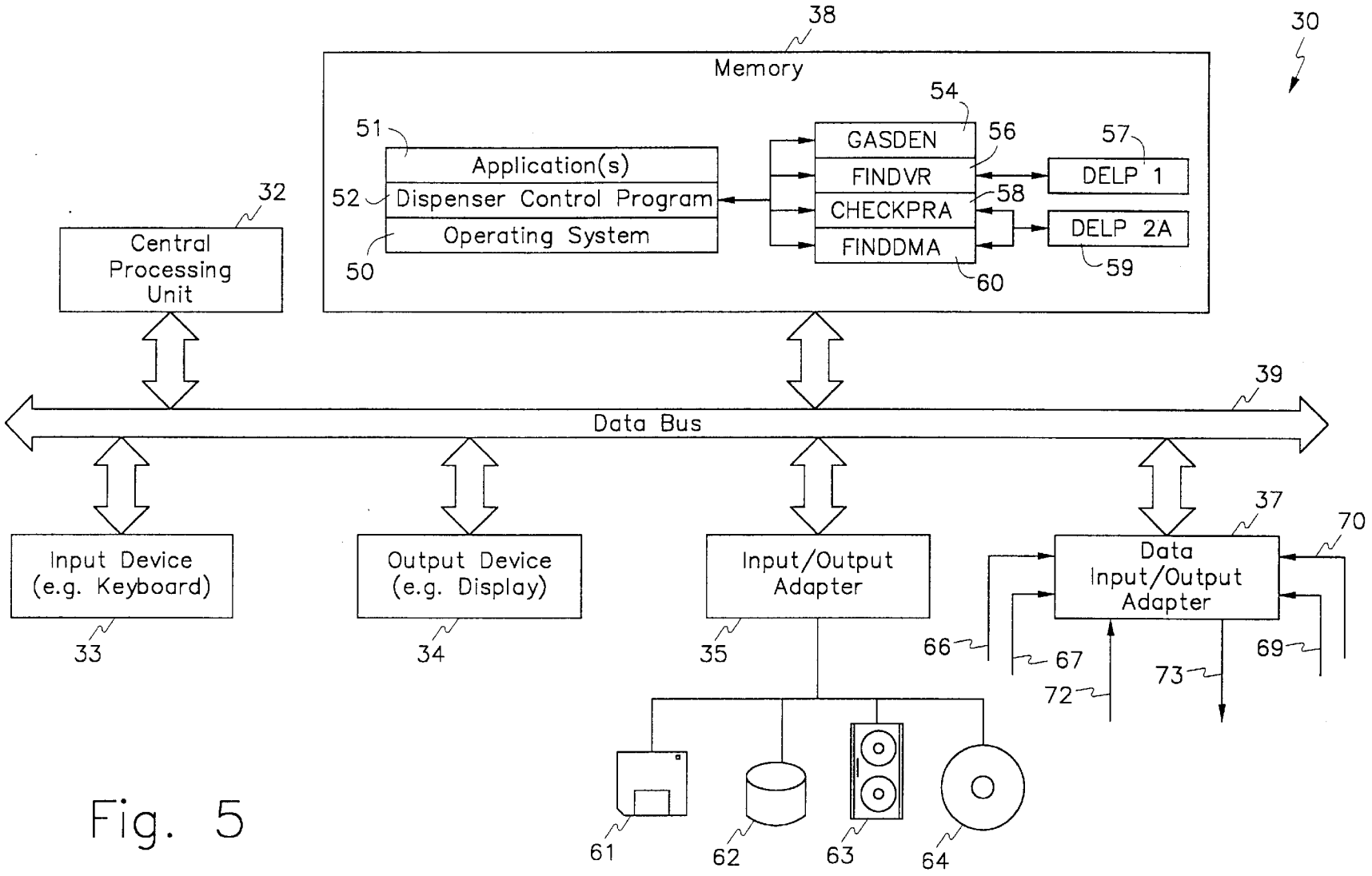
FIG. 5 is a schematic illustration of the control processor illustrated in FIG. 4.

As shown schematically in FIG. 4, pressure transducer 14, temperature transducer 15, mass flow meter 19, solenoid fill valve 21, pressure transducer 27, and ambient temperature transducer 28 each emit separate data signals which are passed on to control processor 30, illustrated generally in FIG. 4, and more specifically in FIG. 5. Control processor 30 also emits a separate control signal back to solenoid fill valve 21 for actuating the solenoid fill valve so that compressed gas may be supplied from gas supply 10 into cylinder 8.

Control processor 30 is schematically shown in greater detail in FIG. 5. Referring now to FIG. 5, control processor 30, a computer, will read and execute computer programs stored on any suitable computer-readable medium for use in automatically dispensing natural gas into cylinder 8 and for maximizing the injection of the desired or computed gas mass into cylinder 8. Control processor 30 has a central processing unit 32, an input device 33, for example, a keyboard, mouse, or other data inputting device, an output device 34, for example a visual display, an input/output adapter 35 for uploading and downloading data and programming information from any suitable computer-readable medium, and a data input/output adapter 37 for receiving signals emitted from the remote sensors and for directing control signals from control processor 30 toward remote locations. Control processor 30 is also equipped with a memory, i.e., a computer-readable medium 38. Memory 38 will store the operating system 50 for the control processor, any additional applications 51 used by the control processor, as well as dispenser control program 52, illustrated schematically in FIGS. 6A through 6I. Although not shown in specific detail in FIG. 5, it is understood by those skilled in the art that memory 38 can comprise a random access memory (not illustrated) and a read only memory (not illustrated) formed as a part thereof. Each of the above described components of control processor 30 communicate with one another through data bus 39 in otherwise conventional fashion.

Dispenser control program 52 utilizes four subroutines in its execution, illustrated schematically in FIG. 5, as well as in FIGS. 6A–6I. The first subroutine is subroutine GASDEN 54 used for determining gas density. The second subroutine is FINDVR 56 which determines the volume of cylinder 8, and which calls a sub-subroutine DELP 1 57 which calculates the change in pressure within cylinder 8 due to a compressed gas mass injection therein. Dispenser control program 52 also includes a third subroutine CHECKPRA which determines whether a predicted cylinder pressure, at the end of the compressed gas mass injection cycle, will exceed the allowable pressure limit for the cylinder. Subroutine CHECKPRA calls sub-subroutine DELP 2A 59, sub-subroutine DELP 2A computing the pressure change within a separate reference cylinder, i.e., a model cylinder, for a given mass injection. The fourth subroutine included in dispenser control program 52 is FINDDMA 60, which finds the change in the injected compressed gas mass for the reference cylinder so that the final pressure in the reference cylinder equals the measured pressure within cylinder 8 during the fill steps which form a part of dispenser control program 52. Subroutine FINDDMA also calls sub-subroutine DELP 2A for the reasons discussed above. The programming instructions/code for each subroutine, and the sub-subroutines, are listed in the Appendix.

Still referring to control processor 30 illustrated in FIG. 5, input/output adapter 35 is equipped to receive data as well as computer programming instructions from any one, or combination of portable storage containers which may include a magnetic floppy disk 61 having a separately provided floppy disk drive (not illustrated), a magnetic hard disk drive 62, a magnetic/digital tape 63 having a separate digital tape drive (not illustrated), and/or a CD-ROM 64, CD-ROM 64 having a separately provided CD-ROM reader (not illustrated).

Data input/output adapter 37 will include any necessary analog to digital, and digital to analog converters needed to process the data signals received from the pressure and temperature transducers, as well as the mass flow meter and solenoid fill valve of gas dispensing system 5. Thus, data input/output adapter 37 receives a first pressure data signal 66 from first pressure transducer 14, a first temperature data signal 67 from first temperature transducer 15, a second pressure data signal 69 from second pressure transducer 23, a second temperature data signal from ambient air transducer 28, a separate data signal 72 from mass flow meter 19, as well as a data signal 73 from solenoid fill valve 21. However, and as shown in FIG. 5, data input/output adapter 37 also emits a control signal 73 from central processing unit 32 back to solenoid fill valve 21. This is also shown schematically in FIG. 4.

The method employed by dispenser control program 52 for automatically dispensing and maximizing the amount of compressed natural gas injected into cylinder 8 is illustrated in FIGS. 6A through 6I. It is understood by those familiar with the art that each of the blocks within FIGS. 6A through 6I is not only a step performed by dispenser control program 52, but also represents a block of executable programming code which together form a part of dispenser control program 52, as well as subroutines GASDEN, FINDVR, CHECKPRA, FINDDMA, and sub-subroutines DELP 1, and DELP 2A. The method illustrated in FIGS. 6A through 6I, as well as the blocks of executable code which comprise this method, can be input into control processor 30 through any one of the portable storage computer readable medium devices shown as a part of input/output adapter 35, or can be stored within memory 38 so that it may be called by central processor 32 for execution.

Figure 6A:
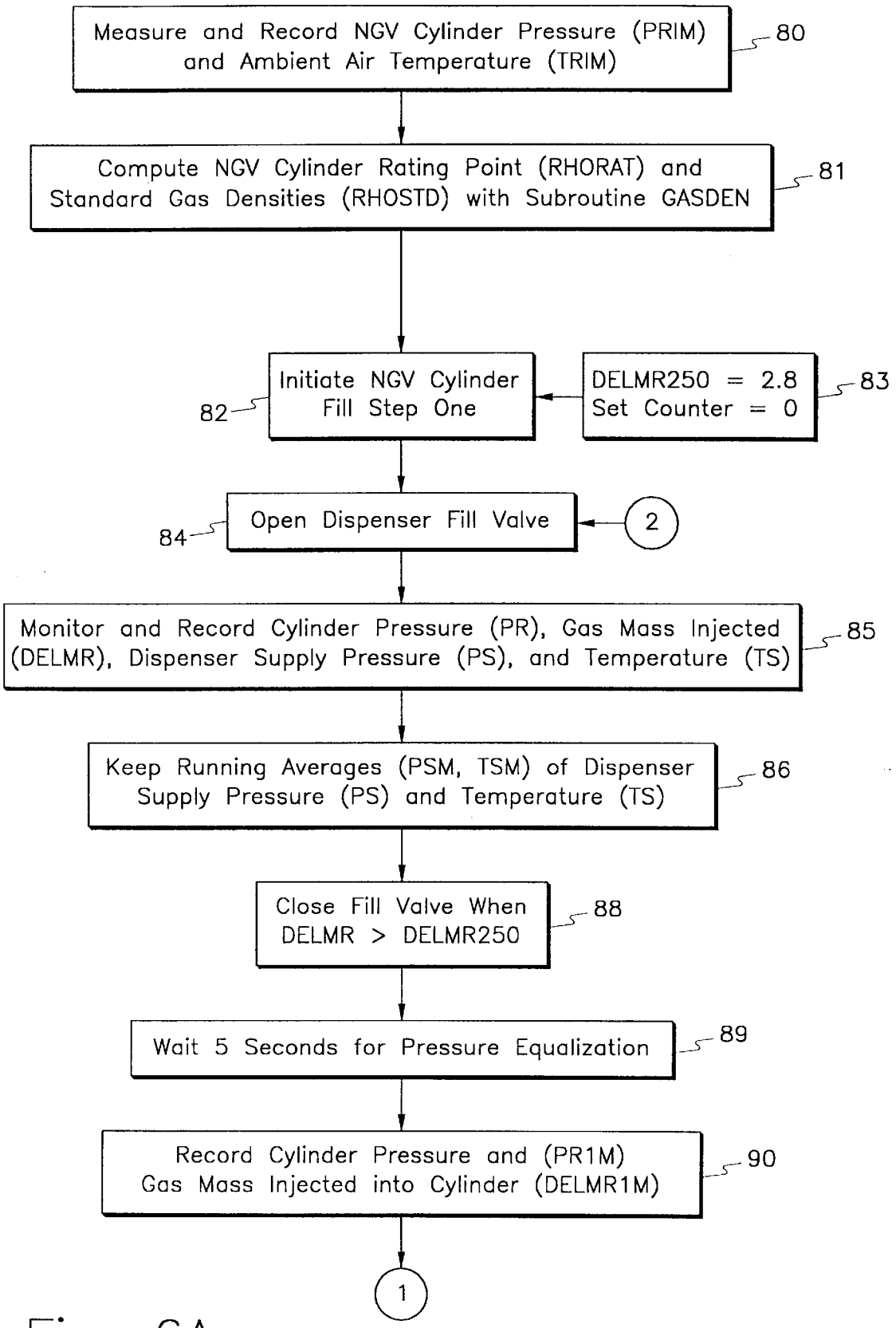
FIGS. 6A–6I are sequential flow charts illustrating the preferred embodiments of the fill process, and the control logic, implemented by the dispensing system of FIG. 4.

Turning now to FIG. 6A, prior to the operation of gas dispensing system 5, the cylinder rating pressure (PRAT) and limit pressure (PRLIM) will be known, which is accomplished as follows. Current NGV gas cylinders come in two industry standard sizes, i.e., pressure ratings, of 3000 psi and 3600 psi. Accordingly, dispenser 17 (FIG. 4) is provided with a fluid-tight dispensing hose 25, having a specifically sized connector 26 thereon for each pressure rated NGV cylinder. Confusion in determining which connector goes with which type or size of NGV cylinder 8 is avoided in that a different sized connector 26 is used for each of the two different NGV cylinders much as an unleaded gasoline nozzle is smaller than a leaded gasoline nozzle. Accordingly, (PRAT) will be specified internally within control processor 30, i.e., programmed in as a part of dispenser control program 52, for each separate dispensing hose/cylinder rating combination. Under the currently accepted standards, American National Standards/American Gas Association standard NGV2-1992, governing NGV cylinders, (PRLIM) is allowed to be twenty-five (25) per-cent greater than (PRAT), and thus (PRLIM) will also be specified internally for each dispensing hose/cylinder rating combination. The NGV customer and/or dispensing system operator does not therefore need to manually input this data before the start of charging operations, thus avoiding any chance of mistake.

Thus, and as shown in block 80 of FIG. 6A, the initial pressure (PRIM) of cylinder 8 is measured and recorded, as well as the ambient air temperature (TRIM) at dispenser 17. Once completed, the program proceeds to block 81 in which dispenser control program 52 computes the cylinder rating point gas density (RHORAT) of cylinder 8, and determines the standard gas density (RHOSTD) within cylinder 8 using subroutine GASDEN, Subroutine GASDEN, as well as subroutines FINDVR, CHECKPRA, FINDDMA, and sub-subroutines DELP 1 and DELP 2A, are set out in the appendix attached hereto, and thus specific reference is not made in greater detail herein to the operations performed by each subroutine, and/or sub-subroutine respectively.

After the execution of the step 81, the dispenser control program proceeds to step 82 in which the first cylinder fill step for filling cylinder 8 is executed by control processor 30. Prior to opening the dispenser fill valve to start the physical transfer of the compressed gas into the cylinder, however, step 83 is first executed in which an internal counter, a software counter created within dispenser control program 52, is set to an initial value of zero within CPU 32. Similarly, a base gas mass (DELMR250), here equal to 2.8 pounds of compressed gas, is also read out of memory into the CPU. The base gas mass value (DELMR250) represents a predetermined amount of gas mass to be injected into cylinder 8 in order to start the process of increasing the pressure within the cylinder by approximately 250 psi for the purposes of computing a first estimate of the volume of the cylinder. This is done by comparing the initial pressure of the cylinder to the preprogrammed increase in gas pressure within the cylinder against a measured, and thus known, gas mass injected into the cylinder in order to calculate an initial estimate of the volume of cylinder 8 with subroutine FINDVR, and sub-subroutine DELP 1, discussed above and below. The value of base gas mass value (DELMR250) corresponds, in energy content, to about one-half gallon of gasoline, which represents the minimum amount of compressed natural gas needed to refuel the vehicle.

For example, although the gas pressure within gas dispensing hose 25 between pressure transducer 27 and cylinder 8 will be equalized to the pressure of the compressed gas held within cylinder 8 once the appropriate hose connector 26 is sealingly received on the fill neck (not illustrated) of the cylinder and opened while solenoid valve 21 remains closed, when even a relatively small amount of compressed gas, here (DELMR250), is passed by dispenser 17 to cylinder 8, a resistance to flow may possibly develop which would make it dynamically difficult to sense when the cylinder pressure reaches the preprogrammed pressure cut-off level during the initial cylinder fill cycle. It has been found that as a result of these resistances to flow the gas pressure in dispensing hose 25 may be dynamically much greater than the actual (dynamic) gas pressure within the storage cylinder. These resistances to flow may arise within the dispenser, the fill neck of the cylinder, or even within the dispensing hose itself, as well as due to the size and configuration of the fill neck, and/or the length of the dispensing hose extending from the dispenser to the fill neck of the cylinder, all of which are listed here only as illustrative examples of what may become resistances to flow.

Thus, the problem that arises with any resistances to flow is that a false pressure reading may occur in which pressure transducer 27 signals the control processor that the preprogrammed pressure increase has been detected in cylinder 8, when in actuality only the pressure in dispensing hose 25 has increased to the predetermined pressure level, and not necessarily the pressure within cylinder 8, due to these flow resistances. Accordingly, preprogrammed base gas mass value (DELMR250) is entered into the dispenser control program and used in the closed loop of steps 83 to 94 of the first fill cycle for use as a target value in determining the first gas mass (DELMR1M), shown in step 90, injected into cylinder 8 and used in subroutine FINDVR to estimate the volume of cylinder 8 a first time.

Figure 1:
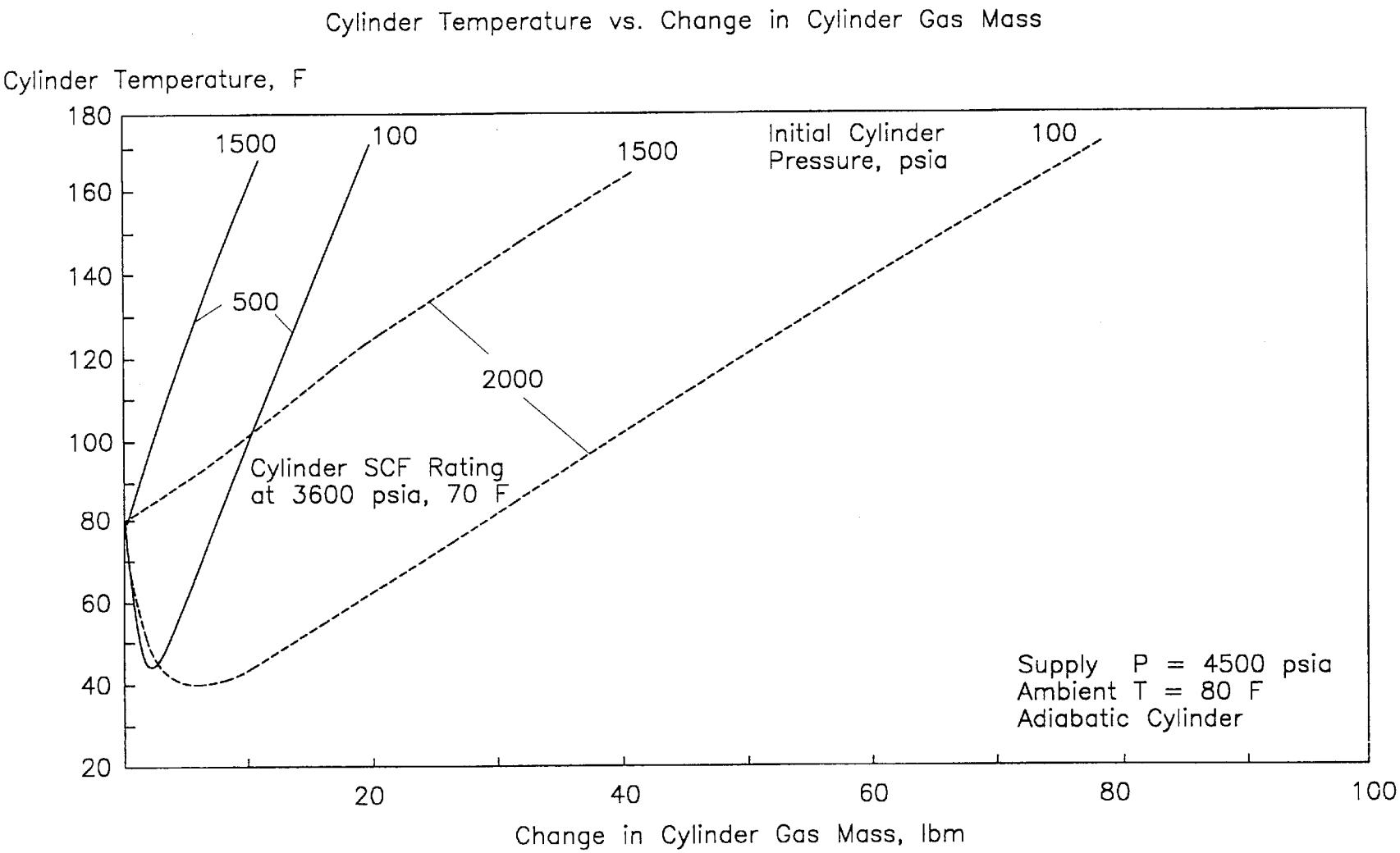
FIG. 1 is a graph illustrating the change of the internal gas temperatures of a gas storage cylinder as a function of the change in injected gas mass within the cylinder.
Figure 2:
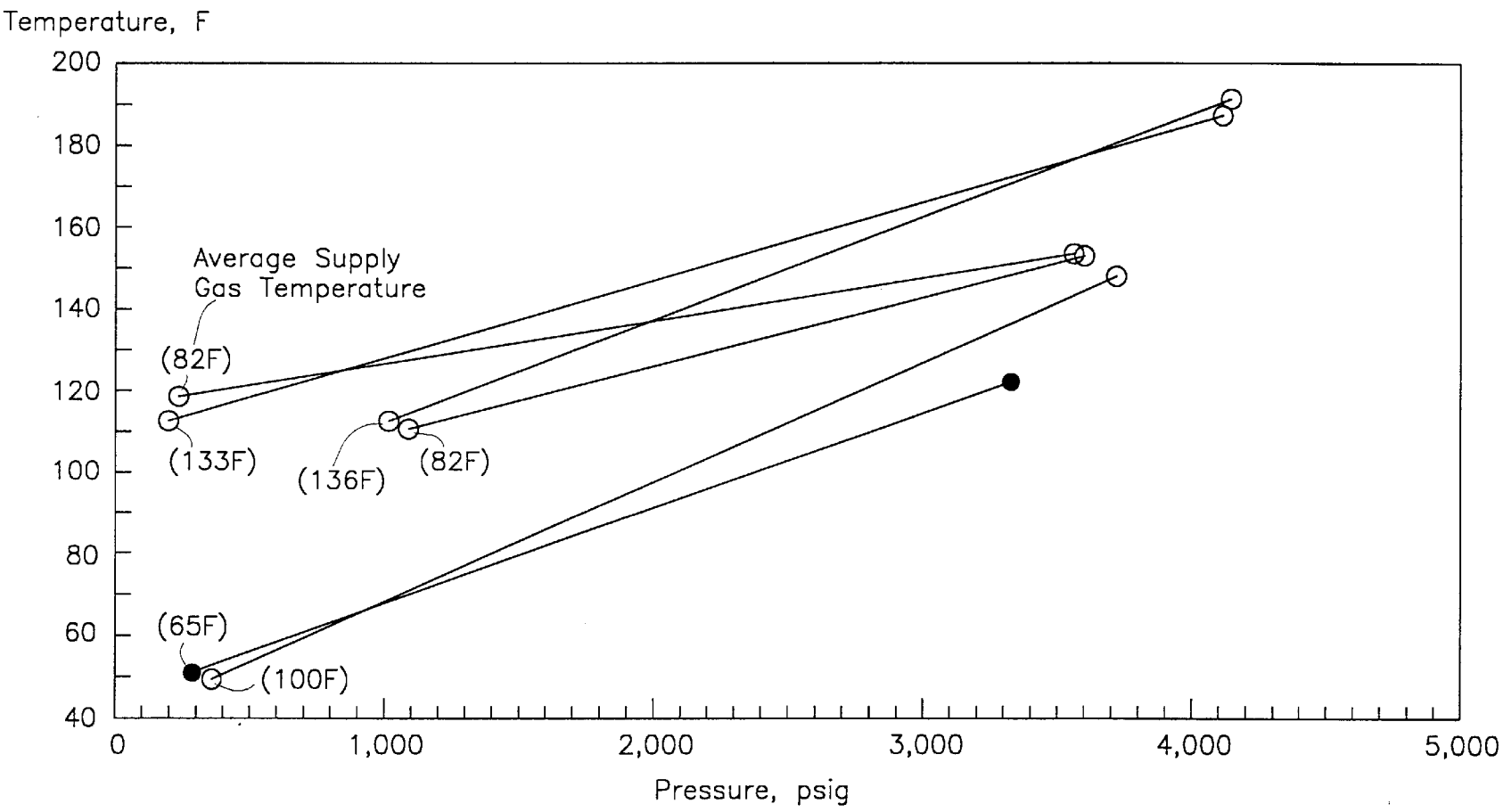
FIG. 2 is a graph showing measured end state cylinder gas conditions for a full cylinder fill state with respect to varying initial cylinder pressure and temperature conditions, and supply gas temperatures.

Returning now to FIG. 6A, once step 83 has been performed, the dispenser control program moves from step 82, which initiated cylinder fill step 1, to step 84 in which solenoid fill valve 21 is opened. In step 85 the dispenser control program then monitors and records the gas pressure (PR) within cylinder 8, the gas mass (DELMR) being injected into the cylinder, as well as the pressure (PS) and temperature (TS) of the compressed gas passed from gas supply 10 through supply plenum 12 as compressed gas is being injected into cylinder 8. The program then executes block 86, where a running average of the dispenser supply pressure (PSM) and temperature supply pressure (TSM), respectively, is maintained by CPU 32. By maintaining these running averages, dispenser control program 52 is thus able to determine the enthalpy of the compressed gas being passed into cylinder 8 which is converted into a gas temperature change in the cylinder resulting from the injection process. The effect of the gas enthalpy changes resulting from the fill process are illustrated in FIGS. 1 and 2, which illustrate the difficulties inherent in determining the amount of the compressed gas mass to be injected into a cylinder in order to maximize cylinder gas/mass fill without being misled or "tricked" into believing there is a full fill based on pressure changes within the cylinder.

Fill step 1 then proceeds to block 88, in which solenoid fill valve 21 is closed once the mass of gas (DELMR) being injected into the cylinder, and continuously monitored in step 85 is determined to be greater than the base gas mass value (DELMR250). This is accomplished by measuring the gas mass injected into the cylinder with mass flow meter 19, and signaling the measured mass to control processor 30. Thereafter, dispensing system 5 waits five seconds for pressure equalization between pressure transducer 27 and cylinder 8, as illustrated in step 89. Step 90 is then executed, in which cylinder pressure (PR1M) is recorded, as well as recording the first gas mass (DELMR1M) injected into cylinder 8.

Figure 6B:
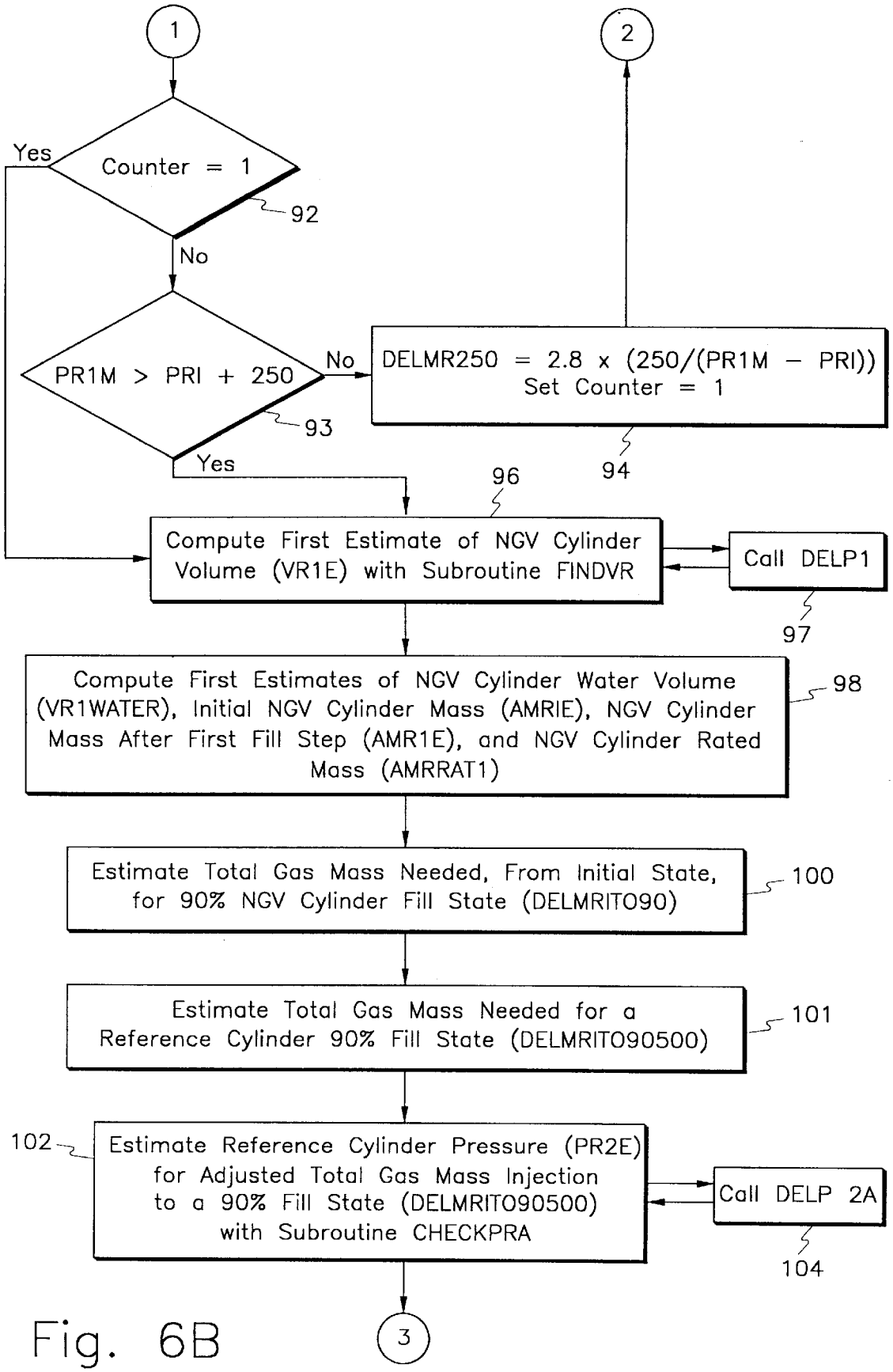
Figure 6C:
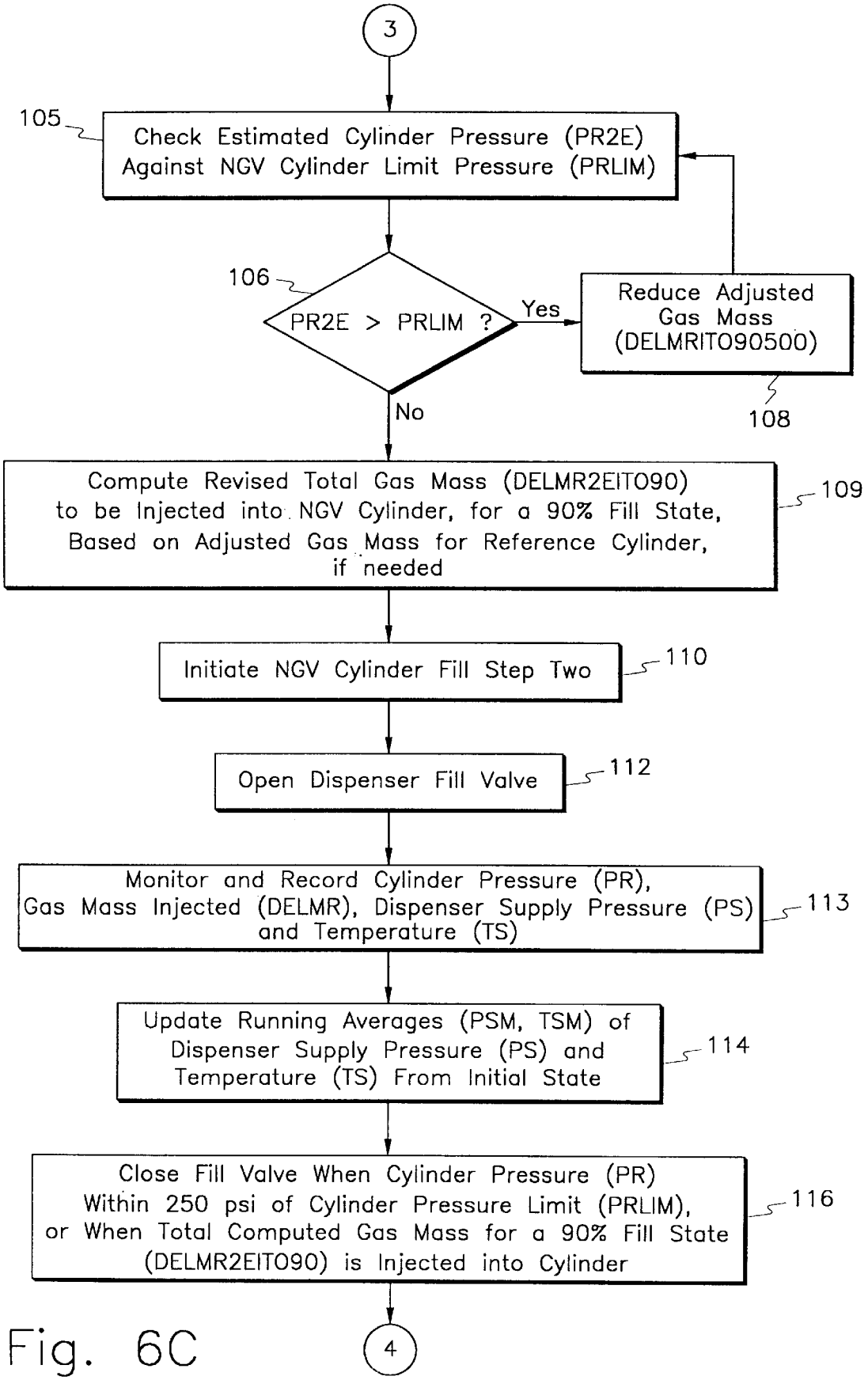

Next, the dispenser control program proceeds to step 92 shown in FIG. 6B, in which the CPU determines whether the counter set to zero in step 83 reads one or zero. If the counter reads zero, the program proceeds to step 93 in which it is determined whether cylinder pressure (PR1M) of step 90 is greater than the initial cylinder pressure (PRI) plus 250 psi. If the answer to this query is no, then step 94 is executed in which (DELMR250) is recalculated according to the formula (DELMR250)=2.8×(250/(PR1M−PRI)), the dispenser control program then looping back to step 84 after setting the counter to the value one. Thereafter, steps 84 to 92 are repeated once more, and only once more, whereupon the counter is read to have a value of one in step 92, the process of fill step one then being completed so that the dispenser control program jumps forward to step 96.

Figure 3:
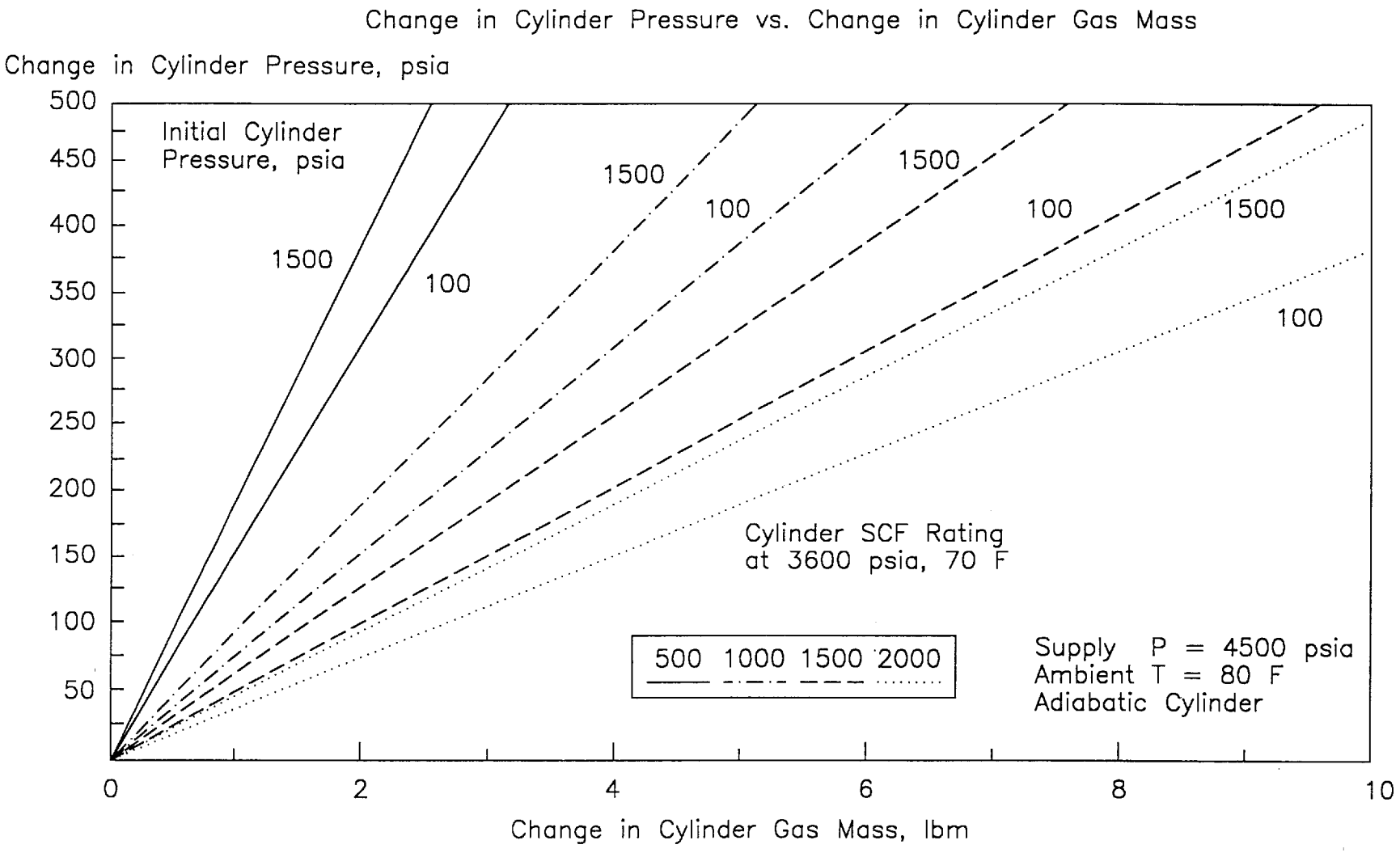
FIG. 3 is a graph showing the relationship between the change in gas storage cylinder pressure as a function of the change in injected cylinder gas mass for two initial cylinder pressure values of 100 and 1,500 psi, and for four cylinder volumes of 500, 1000, 1500 and 2000 s.c.f.

Once fill step 1 is completed, dispenser control program 52 then computes a first estimate of the volume (VR1E) of cylinder 8 in step 96 by using subroutine FINDVR, subroutine FINDVR calling subroutine DELP 1 as shown in block 97. The logic employed in sub-subroutine DELP 1 is shown graphically in FIG. 3, which shows the relationship of the change in cylinder pressure as a function of the change in injected cylinder gas mass. Curves are shown for two initial cylinder pressure values, 100 psi. and 1,500 psi., for a family of four cylinder volumes, 500, 1,000, 1,500, and 2,000 s.c.f A single supply gas pressure of 4,500 psi., and a single gas temperature of 80 degrees Fahrenheit is used for all pressures and volumes. DELP 1 computes the change in cylinder pressure resulting from a specific gas mass injection curve fit via a regression formulation/analysis. DELP 1 is repetitively called by FINDVR to iteratively solve the first volume estimate of cylinder 8.

Thereafter, a first estimate of the cylinder volume is computed in step 98. Step 98 includes the steps of computing the first estimate of the cylinder water volume (VR1WATER), initial cylinder mass (AMRIE), cylinder mass after the first fill step (AMR1E), and the cylinder rated mass (AMRRAT1). The program then proceeds to block 100, whereupon an estimate is computed of the second gas mass needed, (DELMRITO90), from the initial state, for a 90% cylinder fill state. Once this is done, the program proceeds to block 101, in which it computes an estimate of the third gas mass needed (DELMRIT090500) to fill a separately provided reference cylinder (not illustrated) to a 90% fill state. That we are aware of the use of a reference cylinder here as a model is another unique component of our method and apparatus, not heretofore disclosed in the prior art.

The program then proceeds to block 102. In block 102 an estimate of the pressure (PR2E) within the reference cylinder for the adjusted total gas mass injection to a 90% fill state (DELMRITO90500) is computed using subroutine CHECKPRA, subroutine CHECKPRA calling sub-subroutine DELP 2A in block 104. Thereafter, and as a part of subroutine CHECKPRA, in block 105 of FIG. 6C, the estimated cylinder pressure (PR2E) is compared against the limit pressure (PRLIM) of the cylinder, and as shown in block 106, it is determined if the estimated cylinder pressure exceeds the cylinder limit pressure. If so, the program proceeds to block 108, whereby gas mass (DELMRITO90500) is adjusted, i.e., is reduced, the program then looping back to block 105 and repeating the process until the estimated cylinder pressure is determined to be below the cylinder limit pressure, whereupon the program proceeds to block 109, in which control processor 30 will compute a revised total gas mass (DELMR2EIT090) to be injected into cylinder 8 for a 90% fill state, based on the adjustment to the gas mass in the reference cylinder in blocks 105 to 108.

Cylinder fill step 2, shown in block 110, is next executed. Cylinder fill step 2 includes opening solenoid fill valve 21, as shown in block 112, once again monitoring and recording the cylinder pressure, gas mass injected, dispenser supply pressure, and temperature of the process, shown in block 113, and in block 114, updating the running averages (PSM, TSM) of the dispenser supply pressure and temperature supply pressure, respectively, from the initial state. The program then executes block 116, in which solenoid fill valve 21 is closed when the pressure within cylinder 8 is within 250 psi of the cylinder pressure limit, or when the total computed gas mass for a 90% fill state (DELMREIT090) has been injected into cylider 8. Thereafter, and as shown in block 117 of FIG. 6D, the system waits five seconds for pressure equalization within cylinder 8 and dispensing hose 25, whereupon a second pressure reading (PR2M) of the pressure within cylinder 8 is taken through pressure transducer 27, as well as a reading of the actual (second) gas mass (DELMRIT090M) injected into cylinder 8 from its initial state, i.e., prior to the start of the gas transfer process, as illustrated in block 118. The program then proceeds to block 120, ending cylinder fill step 2. Thereafter, the dispenser control program executes step 121 in which the total gas mass required for injection into the reference cylinder in order to match the measured cylinder pressure (PR2M) (step 118) in the reference cylinder from its initial state is computed, which is accomplished by subroutine FINDDMA, and by sub-subroutine DELP 2A, called by the dispenser control program in step 122. Thereafter the dispenser control program can proceed toward a single final fill step shown in FIG. 6D–6E to complete the gas injection process after performing two estimates of the cylinder volume (See block 124), or can proceed to a second intermediate predetermined fill state and then to a final fill state, thus performing two more fill steps and calculating an estimate of the volume a third time, illustrated in FIGS. 6E–6I.

Figure 6D:
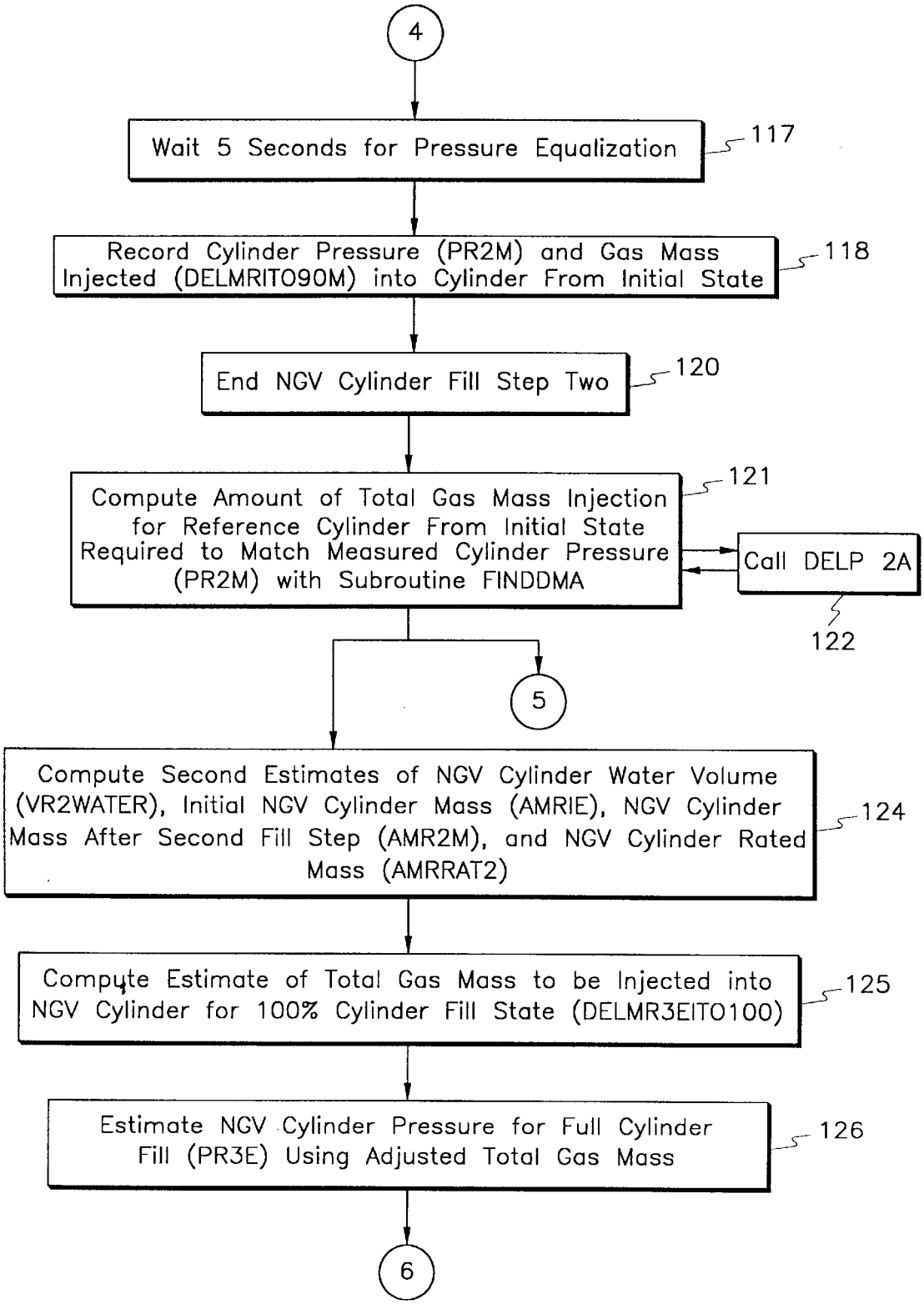
Figure 6E:
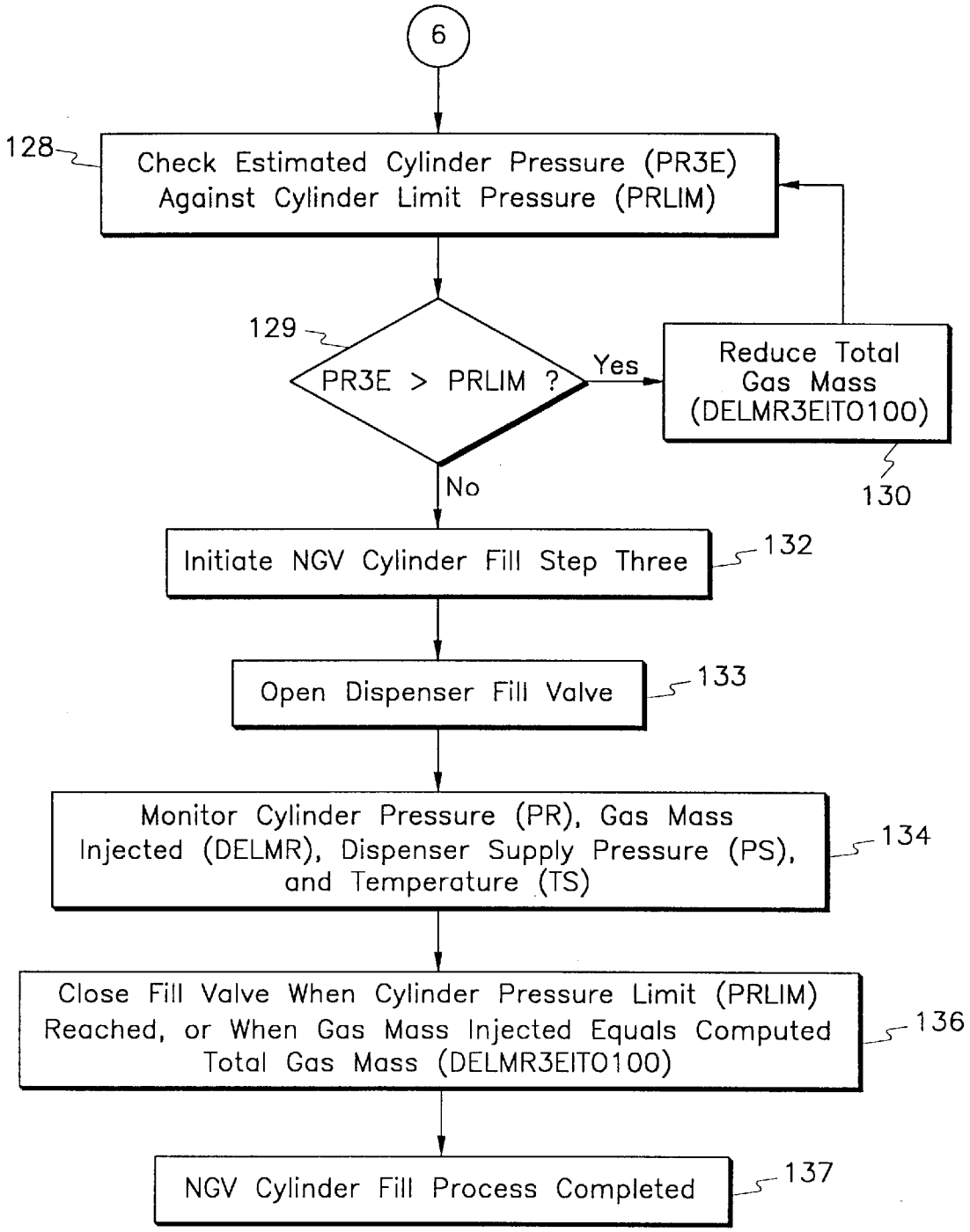

Turning first to the embodiment of the fill process illustrated in FIGS. 6D–6E, in which only one intermediate fill state occurs before the final fill is begun, the program initiates a final fill cycle to complete the injection of gas mass into cylinder 8. Accordingly, in step 124 of FIG. 6D the dispenser control program computes a second estimate of the volume of cylinder 8 by computing a second estimate of the cylinder water volume, initial cylinder mass, cylinder mass after the second fill step, and the rated cylinder mass. The program then proceeds to block 125, in which it computes an estimate of the fifth gas mass (DELMR3EITO100) needed to be injected into cylinder 8 for a 100% cylinder fill state, i.e., a final cylinder fill.

This is done by executing block 126 in which a cylinder pressure (PR3E) is estimated for a full, i.e., 100%, fill state for cylinder 8 using the adjusted total gas mass of block 125. The program then executes block 128 of FIG. 6E, in which the estimated cylinder pressure (PR3E) is compared against the cylinder limit pressure (PRLIM), it being determined in block 129 if the estimated cylinder pressure exceeds the cylinder limit pressure. If so, the program executes block 130 and reduces the total gas mass to be injected into cylinder 8, then looping back to block 128 until such time as it is determined in step 129 that the estimated cylinder pressure is less than the cylinder limit pressure (PRLIM), whereupon the program executes block 132 and initiates cylinder fill step 3.

In cylinder fill step 3 solenoid fill valve 21 is opened in block 133, the cylinder pressure, gas mass injected, dispenser supply pressure, and temperature are once again monitored and recorded as shown in block 134, and solenoid fill valve 21 is closed when the cylinder pressure limit is attained, or preferably, when the gas mass injected into cylinder 8 equals the computed total gas mass (DELMR3EITO100) shown in block 136. Thereafter, and as illustrated in block 137, the cylinder fill process is completed.

The advantages of this cylinder fill process over others known in the art is that at least two estimates of the volume of cylinder 8 are taken, which enables a more accurate determination of the total gas mass that may be injected into cylinder 8 regardless of cylinder pressure readings taken of the process against the cylinder limit pressure so that a more accurate and complete fill or charging process is achieved so that the gas mass injected into cylinder 8 is maximized in a safe and efficient manner, thus maximizing the travel distance of motor vehicle 7 between gas injection or charging operations. Another unique aspect of the process described in FIGS. 6A through 6E is that the enthalpy of the compressed gas being injected into cylinder 8 is constantly being monitored, recorded, averaged, and used in the process to accurately determine the amount of gas mass that may be injected into cylinder 8 to once again maximize the cylinder gas mass fill.

Although the novel process illustrated in FIGS. 6A through 6E teaches a method for safely, accurately, and efficiently maximizing the injection of gas mass into a motor vehicle natural gas cylinder, this process is even more accurate if a series of intermediate fill steps is used in order to obtain several volume readings for cylinder 8, thus leading to greater precision and control in maximizing the gas mass injected into cylinder 8. Accordingly, a fill process using a second intermediate fill step followed by a final fill step is shown in FIGS. 6F–6I.

Figure 6F:
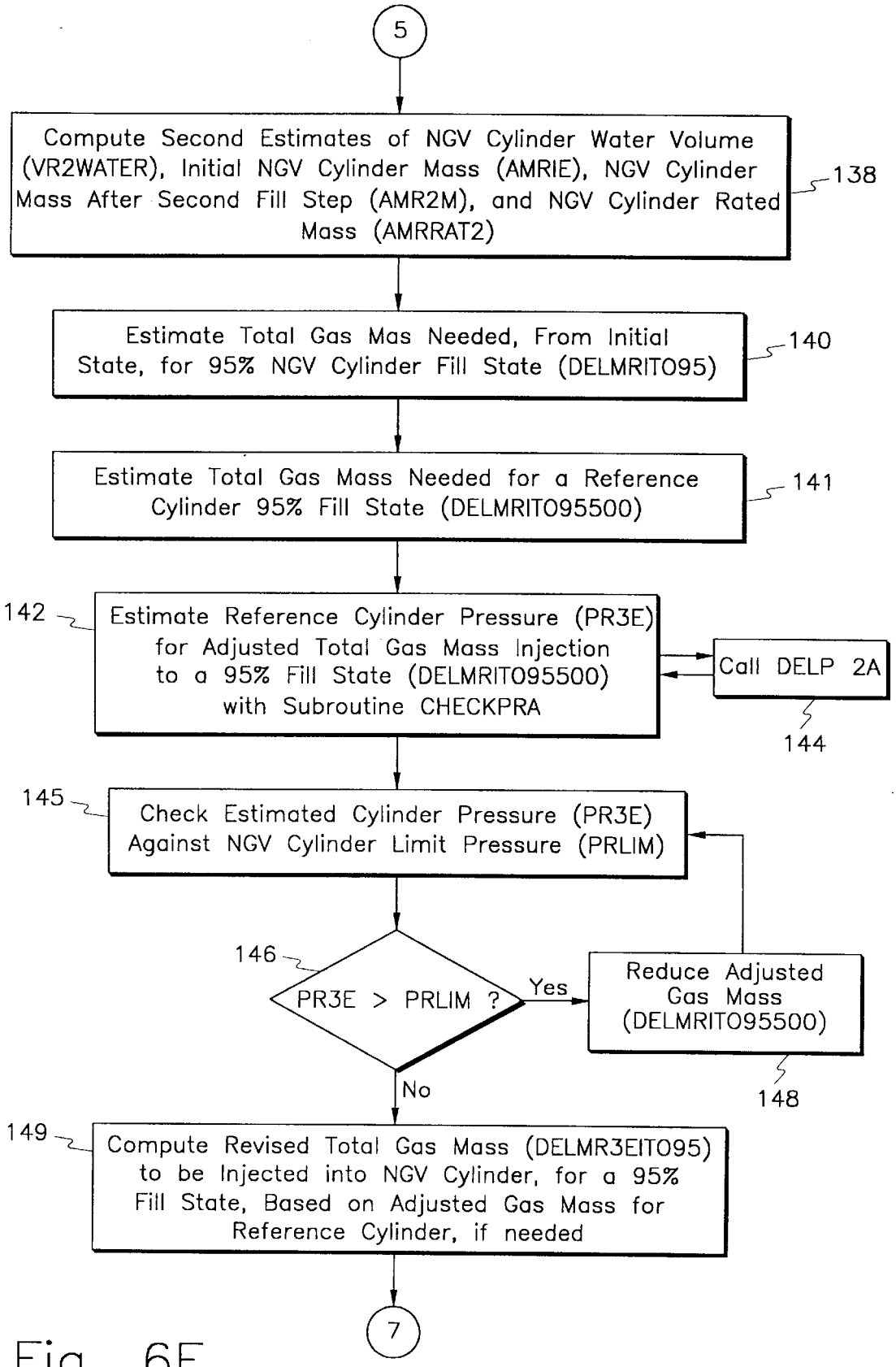

Turning first to FIG. 6F, block 138 is executed by dispenser control program 52 after completing blocks 121 and 122 of FIG. 6D. In block 138, the dispenser control program computes a second estimate of the cylinder water volume, initial cylinder mass, and cylinder mass after the second fill step, blocks 104 through 114, as well as the cylinder rated mass. The program then executes block 140, in which it determines a fourth mass (DELMRITO95) needed, from the initial state, for a 95% or second intermediate fill state for cylinder 8.

The program then executes block 141 in which it determines a fifth mass (DELMRITO95500) needed for the reference cylinder (not illustrated) to also attain the 95% fill state for cylinder 8. Once this is accomplished, the program executes subroutine CHECKPRA in block 142 in which it estimates a reference cylinder pressure (PR3E) for the fifth gas mass injection to a 95% fill state within cylinder 8, subroutine CHECKPRA calling sub-subroutine DELP 2A in block 144. Subroutine CHECKPRA will then check the estimated cylinder pressure (PR3E) against the cylinder limit pressure (PRLIM) as shown in blocks 145 and 146. If the estimated cylinder pressure exceeds the cylinder limit pressure in block 146, the program executes block 148, in which the fifth gas mass determined in block 141 is adjusted downward, the program then looping back to blocks 145 and 146 until such time as the estimated cylinder pressure does not exceed the cylinder limit pressure, whereupon subroutine CHECKPRA is completed and the program executes block 149 in which the fourth gas mass determined in block 140 is adjusted downward, based upon the adjustment of fifth gas mass (DELMRITO95500) in block 148, to attain a 95% fill state within cylinder 8.

Figure 6G:
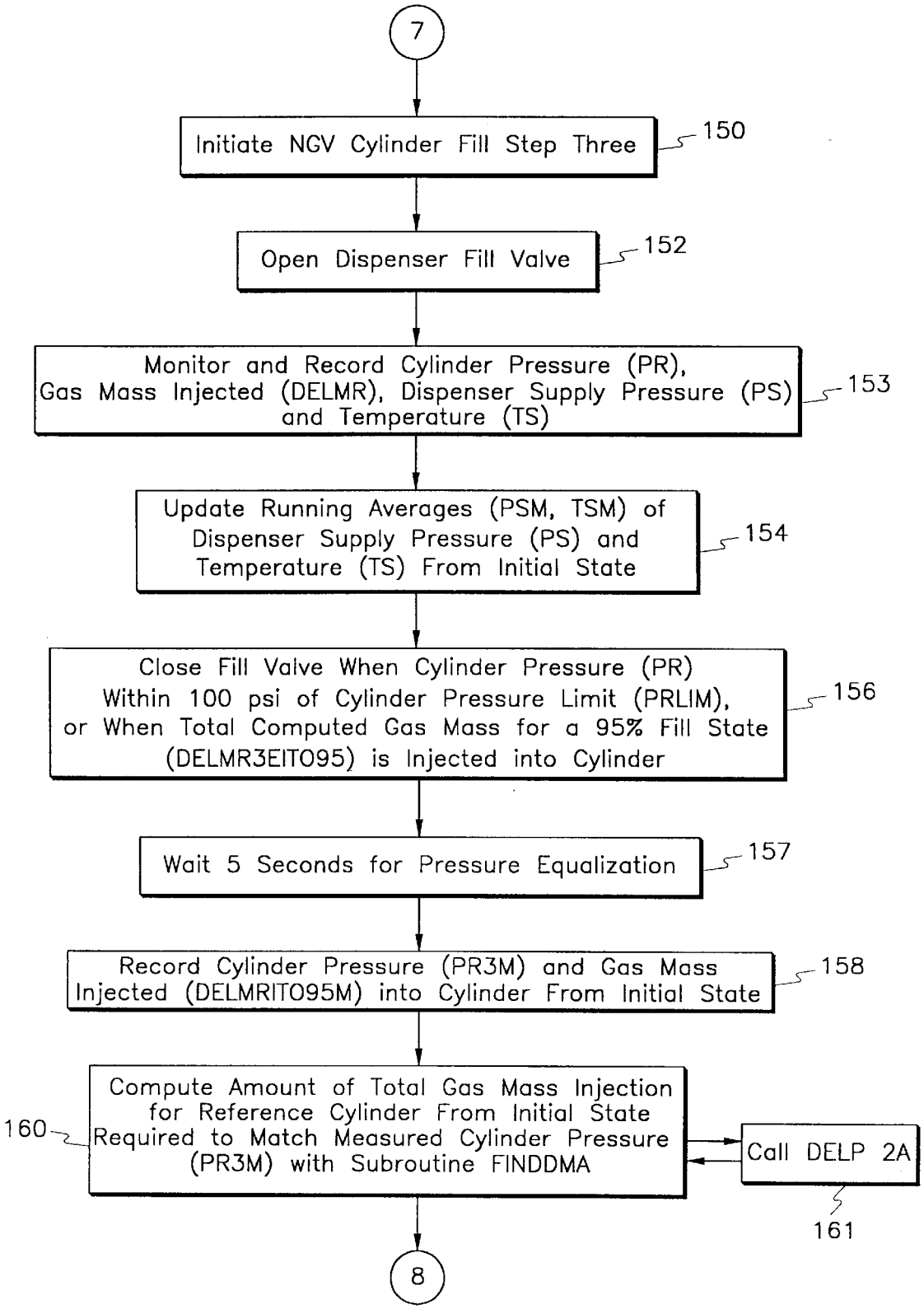

The program then proceeds to a third cylinder fill step as shown in block 150 of FIG. 6G, for the second intermediate fill step of cylinder 8 to a second predetermined fill state. Cylinder fill step 3 commences in block 152 in which solenoid fill valve 21 is opened and then proceeds to block 153 in which the program once again monitors and records the pressure and gas mass injected into cylinder 8, as well as the pressure and temperature of the supply gas, this information being used to once again measure the enthalpic reaction within cylinder 8 by updating the running averages of dispenser supply pressure (PSM) and temperature (TSM), respectively in step 154. Thereafter, and as shown in block 156, the program will close solenoid fill valve 21 by sending a control signal 73 to solenoid fill valve 21 (FIG. 4) when the pressure within cylinder 8 is within 100 psi of the cylinder pressure limit, or more preferably, when the total computed gas mass for 95% fill state has been injected into cylinder 8. Thereafter, and as with cylinder fill step 2, the system waits five seconds for pressure equalization as shown in block 157, and then proceeds to execute block 158, in which it records the pressure (PR3M) and gas mass injected (DELMRITO95M) into cylinder 8 from the initial state.

Once this is done, the dispenser control program executes block 160, in which it calls subroutine FINDDMA to compute the amount of the total gas mass injection, the sixth gas mass, for the reference cylinder (not illustrated) from its initial state required to match the measured cylinder pressure (PR3M), and calls sub-subroutine DELP 2A in block 161 to help accomplish this task.

Figure 6H:
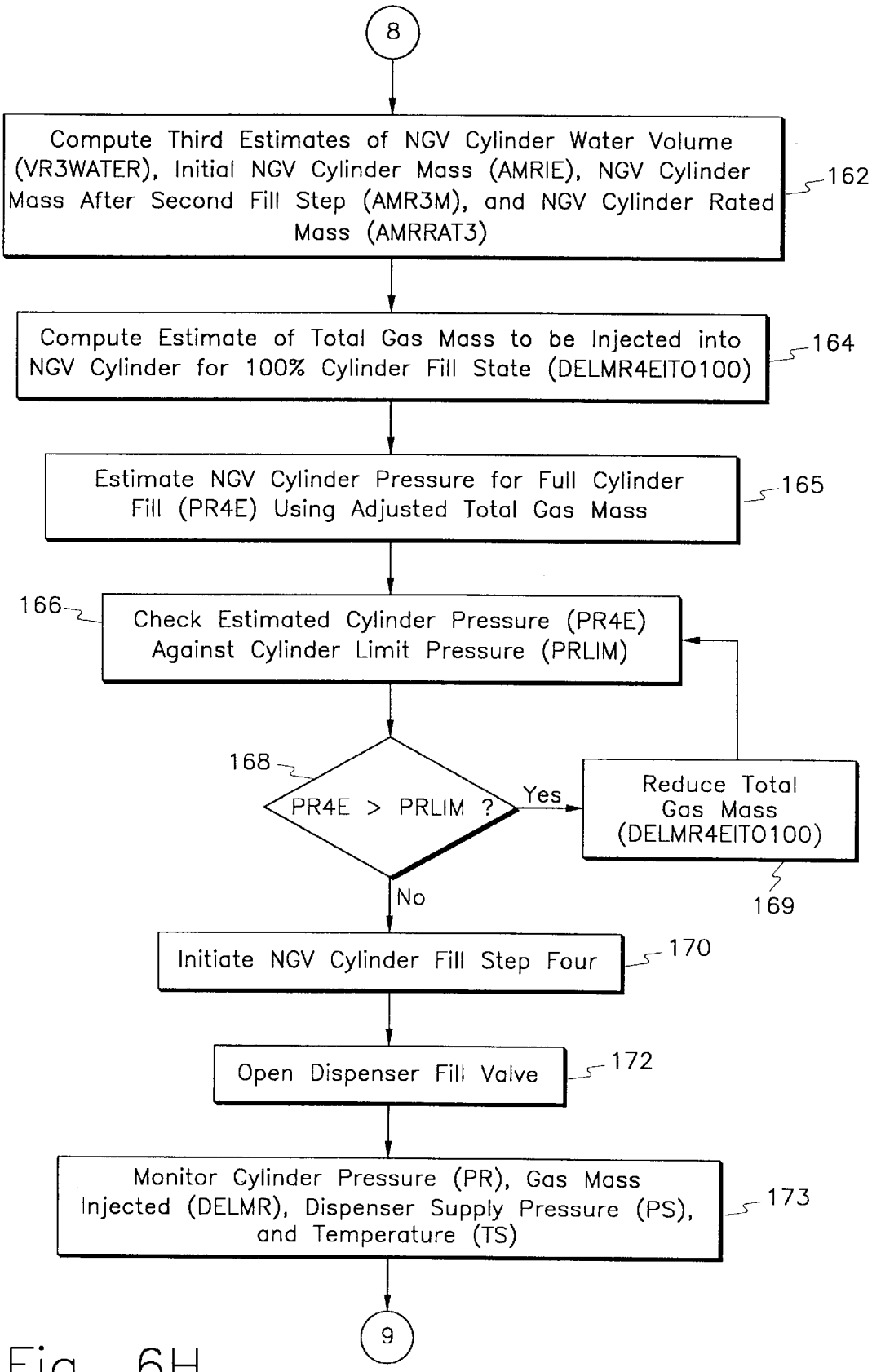

Thereafter, and as shown in block 162 of FIG. 6H, dispenser control program 52 computes a third estimate of the volume of cylinder 8 by calculating estimates of the cylinder water volume, initial cylinder mass, cylinder mass after the second fill step, and rated cylinder mass. The greater the number of intermediate fill steps, for example, an intermediate fill step of 45%, a second intermediate fill step of 65%, a third intermediate fill step of 85%, and a fourth intermediate fill step of 95%, the more accurate the determination of the cylinder volume will be and thus a more accurate determination of the total gas mass to be injected into the cylinder in order to maximize cylinder fill will result. Thus, and although only four cylinder fill steps are shown in the process of FIGS. 6A–6D (through steps 121 and 122), and 6F–6I, it is anticipated that more than four fill steps can be performed by the apparatus of FIGS. 4 and 5, and the method, i.e., computer program, of FIGS. 6A through 6I.

Returning to FIG. 6H, the program then executes block 164 in which it determines a seventh mass (DELMR4EITO100) required to be injected into cylinder 8 to attain a 100% or final cylinder fill state. The program then proceeds to block 165 in which it computes an estimate of the cylinder pressure (PR4E) needed for a full cylinder fill using the seventh gas mass of block 164. This is accomplished in blocks 166 and 168, in which the estimated cylinder pressure (PR4E) is compared against the cylinder limit pressure (PRLIM), and if the estimated cylinder pressure exceeds the cylinder limit pressure as shown in block 168, the dispenser control program executes block 169 in which the seventh gas mass determined in block 164 is reduced, the program then looping back to block 166 and block 168 until such time as the estimated cylinder pressure (PR4E) does not exceed the cylinder limit pressure (PRLIM), whereupon the program executes cylinder fill step four in block 170, and initiates the final cylinder fill step.

Figure 6I:
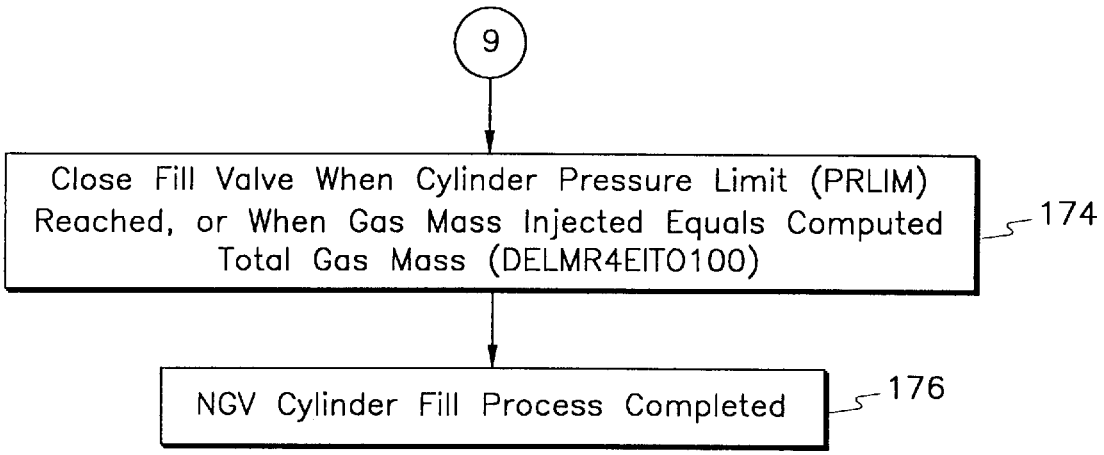

The final cylinder fill step includes opening solenoid fill valve 21 as shown in block 172, again monitoring the cylinder pressure and mass of gas injected into cylinder 8, as well as the pressure and temperature of the compressed gas supply in block 173, and finally, in block 174 of FIG 6I, preferably closing solenoid fill valve 21 when the seventh gas mass has been injected into cylinder 8, or closing the solenoid fill valve when the cylinder pressure limit has been reached. The program then executes block 176 in which the cylinder fill process is completed, and control signal 73 (FIG. 4) closes solenoid fill valve 21. Connector 26 may then be removed from motor vehicle 7, and motor vehicle 7 is free to pass on its way.

Contrasted with the known prior art, for example, U.S. Pat. No. 5,259,4242 to Miller et al, our method and apparatus provides an improved natural gas dispensing system which accurately determines the volume of any natural gas vehicle cylinder 8, and will safely, efficiently, and quickly perform a fast fill charging process in which the maximum amount of compressed gas is injected into the cylinder to maximize the distance traveled by motor vehicle 7 between gas charging operations by constantly monitoring, recording, and averaging the enthalpic reaction resulting from the injection of compressed gas into cylinder 8, and by computing several estimates of the volume of the cylinder in order to maximize the gas mass injected therein While preferred embodiments of our invention have been disclosed in the foregoing specification, it is understood by those skilled in the art that variations and modifications thereof can be made without departing from the spirit and scope of the invention, as set forth in the following claims. Moreover, the corresponding structures, materials, acts, and equivalents of all means or step plus function in the claimed elements are intended to include any structure, material, or acts for performing the functions in combination with other claimed elements, as specifically claimed herein.

APPENDIX

```
$NOTRUNCATE
   SUBROUTINE GASDEN(P,T,RHO)
C
C   THIS ROUTINE COMPUTES DENSITY OF MEAN U.S. GAS MIXTURE, FOR GIVEN
C   PRESSURE AND TEMERATURE (PRESSURE RANGE: 14.7-5000 PSIA)
C   UNITS:    P   PSIA
C            T   F
C          RHO   LBM/FT**3
C
   DIMENSION A0(5),A1(5),A2(5),A3(5),A4(5),A5(5),A6(5),A7(5),A8(5)
   DATA A0/-.2994295E+00,-.3343221E+01,-.2628989E+02,+.3092211E+02,
  &-.6128675E-02/
   DATA A1/-.3487948E-02,-.1842292E-01,-.5661105E-01,+.3983686E-02,
  &-.4368347E-03/
   DATA A2/+.8219936E-03,+.1352748E-01,+.8513020E-01,-.1486127E+00,
  &+.20888281E-04/
   DATA A3/+.3162543E+01,+.5992787E+01,+.1877627E+02,+.6835460E+01,
  &+.1742212E+01/
   DATA A4/-.1058533E+01,+.5557355E+00,+.2854977E+00,-.6623889E+00,
  &+.2014086E+00/
   DATA A5/+.8145651E+00,+.1126193E-01,-.5140347E-01,+.1701009E-01,
  &+.2001732E+00/
   DATA A6/+.9307038E-06,-.1638089E-05,+.6831632E-06,+.6680183E-06,
  &-.4553512E-06/
   DATA A7/-.6011406E-06,-.1360555E-04,-.6458707E-04,+.1462390E-03,
  &-.1761429E-07/
   DATA A8/+.2192528E-05,+.1921265E-04,+.4269540E-04,-.1280760E-04,
  &+.3721930E-06/
   IF (P.GT.5000) THEN
     WRITE (*,*) 'PRESSURE > 5000 PSIA IN SUBR GASDEN, P=',P
     WRITE (*,*) 'PROGRAM STOPS'
     STOP
   ENDIF
   IF (P.GE.100..AND.P.LT.300.) J=1
   IF (P.GE.300..AND.P.LT.1000.) J=2
   IF (P.GE.1000..AND.P.LT.2500.) J=3
   IF (P.GE.2500..AND.P.LE.5000.) J=4
   IF (P.LT.100.) J=5
   X1=P
   X2=T+459.6
   X3=X1/X2
   X4=X3*X3
   X5=X3*X4
   X6=X1**2
   X7=X2**2
   X8=X1*X2
   RHO=A0(J)+A1(J)*X1+A2(J)*X2+A3(J)*X3+A4(J)*X4
   RHO=RHO+ A5(J)*X5+A6(J)*X6+A7(J)*X7+A8(J)*X8
   RETURN
   END
```

```
$NOTRUNCATE
   SUBROUTINE FINDVR(PS,TS,PRI,PRF,DELMRMEAS,VR1E)
C
C   THIS ROUTINE FINDS A CYLINDER VOLUME, VR1E, AFTER A SMALL
C   INJECTION OF MASS
C
C   ADJUST THE MEASURED DELTA MASS TO THE REGRESSION RANGE OF
C   SUBROUTINE DELP1,I.E. 0 TO 7 LBM.
   ICODE=DELMRMEAS/7.+1
   DELMR=DELMRMEAS/ICODE
C
   VROLD=1000.
   CALL DELP1(VROLD,PS,TS,PRI,DELMR,DELPOLD)
   PROLD=PRI+DELPOLD
   VRNEW=1250.
10  CALL DELP1(VRNEW,PS,TS,PRI,DELMR,DELPNEW)
   PRNEW=PRI+DELPNEW
C
   ERROR=PRNEW-PRF
   IF (ABS(ERROR).GT.5.) THEN
    SLOPE=(PRNEW-PROLD)/(VRNEW-VROLD)
    VROLD=VRNEW
    PROLD=PRNEW
    DELVR=.5*ERROR/SLOPE
    IF (ABS(DELVR).GT.100..AND.DELVR.GE.0.) DELVR=100.
    IF (ABS(DELVR).GT.100..AND.DELVR.LE.0.) DELVR=-100.
C
C     WRITE (*,*) 'DELVR',DELVR
C
    VRNEW=VRNEW-DELVR
    IF (VRNEW.LT.250.) THEN
     VRNEW=250.
     WRITE (*,*) ' CYLINDER VOLUME ITEARATION FAILURE - PROGRAM STO
  &PS'
     STOP
    ENDIF
    GO TO 10
   ELSE
    VR1E=VRNEW*ICODE
    RETURN
   END IF
   RETURN
   END
```

```
$NOTRUNCATE
   SUBROUTINE DELP1(VR,PS,TS,PRI,DELMR,DELP)
C
C   THIS ROUTINE COMPUTES THE DELP EXPECTED FOR SMALL MASS INJECTIONS
C   INTO AN NGV CYLINDER
C
C   UNITS:
C       VR    SCF (RATED AT 3600 PSIA, 70 F)
C       PS    PSIA
C       TS    F
C       PRI   PSIA
C       DELMR  LBM
C       DELP   PSI
C
   A0= +.2276295E+03
   A1= -.8072531E+00
   A2= -.7289587E-02
   A3= +.1068918E+01
   A4= +.1086674E-01
   A5= +.2106255E+03
   A6= -.7376524E+01
   A7= +.5790426E-03
   A8= -.1122428E-06
   A9= +.2000129E-05
   A10=+.9500802E-08
   A11=+.1745315E-01
   A12=-.4552160E-04
   A13=-.9907739E-01
   A14=+.2313142E-05
   A15=+.8719245E+04
C
   X1=VR
   X2=PS
   X3=TS
   X4=PRI
   X5=DELMR
   X6=X5*X5
   X7=X1*X1
   X8=X1*X7
   X9=X4*X4
   X10=X4*X9
   X11=X4*X5
   X12=X4*X1
   X13=X5*X1
   X14=X13*X13
   X15=X4*X1/(TS+459.6)
   X15=X5/X15
   X15=X15*X15
C
   DELP=A0+A1*X1+A2*X2+A3*X3+A4*X4+A5*X5+A6*X6+A7*X7+A8*X8+A9*X9
   DELP=DELP+A10*X10+A11*X11+A12*X12+A13*X13+A14*X14+A15*X15
   RETURN
   END
```

```
$NOTRUNCATE
   SUBROUTINE CHECKPRA(PS,TS,PRI,TRI,PRLIM,DELMRIN,PRPRED,DELMROUT)
C
C   THIS ROUTINE CHECKS, FOR DELMRIN, WHETHER THE PREDICTED CYLINDER
C   PRESSURE, IN A 500 SCF CYLINDER, WILL EXCEED PRLIM.  IF IT DOES,
C   DELMR IS ADJUSTED DOWNWARD IN .025 LBM INCREMENTS, TO PASS THAT TEST.
C   THE OUTPUT DELMR WHICH PASSES THE TEST IS ARGUMENT DELMROUT
C
   DELMR=DELMRIN
10  CALL DELP2A(PS,TS,PRI,TRI,DELMR,DELP)
   PRPRED=PRI+DELP
   IF (PRPRED.GT.PRLIM) THEN
    DELMR=DELMR-.025
    GO TO 10
   ELSE
    DELMROUT=DELMR
    RETURN
   END IF
   RETURN
   END
```

```
$NOTRUNCATE
    SUBROUTINE FINDDMA(PS,TS,PRI,TRI,PRFM,DELMR)
C
C    THIS ROUTINE FINDS THE DELMR, FOR A 500 SCF CYLINDER,
C    SUCH THAT THE PRF MATCHES THE INPUT MEASURED PRFM
C
    DELMOLD=20.
    CALL DELP2A(PS,TS,PRI,TRI,DELMOLD,DELPOLD)
    PROLD=PRI+DELPOLD
    DELMNEW=21.
10  CALL DELP2A(PS,TS,PRI,TRI,DELMNEW,DELPNEW)
    PRNEW=PRI+DELPNEW
C    WRITE (*,*) 'PRNEW,DELMNEW',PRNEW,DELMNEW
    ERROR=PRNEW-PRFM
    IF(ABS(ERROR).GT.5.) THEN
     SLOPE=(PRNEW-PROLD)/(DELMNEW-DELMOLD)
     DELMOLD=DELMNEW
     PROLD=PRNEW
     DELM=.5*ERROR/SLOPE
     IF (ABS(DELM).GT.1..AND.DELM.GT.0.) DELM=.1
     IF (ABS(DELM).GT.1..AND.DELM.LT.0.) DELM=-.1
     DELMNEW=DELMNEW-DELM
     GO TO 10
    ELSE
     DELMR=DELMNEW
     RETURN
    END IF
    RETURN
    END
```

(5)

```
$NOTRUNCATE
   SUBROUTINE DELP2A(PS,TS,PRI,TRI,DELMR,DELP)
C
C   THIS ROUTINE COMPUTES THE DELP EXPECTED FOR MASS INJECTIONS
C   INTO A 500 SCF NGV CYLINDER (BASED ON 6/5/95 AND 11/21/95 REGRESSIONS)
C
C   UNITS:
C       PS    PSIA
C       TS    F
C       PRI   PSIA
C       TRI   F
C       DELMR  LBM
C       DELP   PSI
C
   IF (TRI.GE.50) THEN
   A0= -.1181484E+03
   A1= +.4809314E-02
   A2= +.4307871E+00
   A3= +.7606027E+00
   A4= -.2126258E+00
   A5= +.8949869E+02
   A6= -.7304727E+01
   A7= +.6741005E+00
   A8= -.9749865E-02
   A9= -.1566937E-02
   A10=+.9088554E-06
   A11=-.1591090E-09
   A12=-.1019546E-04
   A13=+.5050260E+04
   A14=-.1933335E+05
   A15=+.6953606E+00
   A16=+.6091729E-01
   A17=+.1219411E-05
   ELSE
   A0= -.6295708E+02
   A1= +.1137363E-02
   A2= -.2910651E+00
   A3= -.2989736E+00
   A4= -.2428457E-01
   A5= +.1906508E+03
   A6= -.1806205E+02
   A7= +.1202792E+01
   A8= -.2088573E-01
   A9= +.1237217E-03
   A10=+.5009747E-07
   A11=-.1639634E-10
   A12=-.8676208E-04
   A13=-.5754610E+03
   A14=+.3579647E+04
   A15=+.8329901E+00
   A16=+.8973119E-02
   A17=+.3187786E-05
   END IF
C
```

(6)

```
      X1=PS
      X2=TS
      X3=PRI
      X4=TRI
      X5=DELMR
      X6=X5*X5
      X7=X5*X5*X5
      X8=X5*X5*X5*X5
      X9=X3*X3
      X10=X3*X3*X3
      X11=X3*X3*X3*X3
      X12=(X2-X4)**3
      X13=X5/X3
      X14=X13*X13
      X15=X5*X2
      X16=X5*X3
      X17=X16**2
C
      DELP=A0+A1*X1+A2*X2+A3*X3+A4*X4+A5*X5+A6*X6+A7*X7+A8*X8+A9*X9
      DELP=DELP+A10*X10+A11*X11+A12*X12+A13*X13+A14*X14+A15*X15
      DELP=DELP+A16*X16+A17*X17
      RETURN
      END
```

We claim:

1. A computer readable medium containing software for the control of the operation of an automated compressed gas dispenser system used for filling compressed gas cylinders having an initial pressure state and a known pressure limit, said software comprising:

logic to measure and store an initial cylinder pressure and ambient air temperature;

logic to compute the cylinder rating point gas density and determining the standard gas density within the cylinder;

logic to control the injection of a beginning mass of gas into the cylinder, thereby elevating the pressure inside the cylinder to a beginning pressure threshold;

logic to monitor and store the beginning mass of the gas injected into the cylinder;

logic to calculate a running average of a supply gas temperature and a supply gas pressure; and logic to estimate the volume of the cylinder based on the beginning mass of the gas injected into the cylinder.

2. The computer readable medium of claim 1, wherein said computer readable medium is a magnetic disk.

3. The computer readable medium of claim 1, wherein said computer readable medium is a magnetic tape.

4. The computer readable medium of claim 1, wherein said computer readable medium is a compact disk (CD).

5. The medium of claim 1, said software further comprising:

logic to determine an intermediate mass of gas necessary to fill the cylinder from the initial pressure state to a predetermined threshold fill percentage;

logic to control the injection of the intermediate mass of gas to achieve the predetermined threshold fill percentage.

6. The medium of claim 5, said software further comprising:

logic to determine a final mass of gas necessary to fill the cylinder from the predetermined threshold fill percentage to a full cylinder fill state;

logic to control the injection of the final mass of gas to achieve the full cylinder fill state.

7. The medium of claim 1, wherein said logic to control the injection of a beginning mass of gas into the cylinder further comprises:

logic to control the injection of a base mass of gas into the cylinder;

logic to determine whether the pressure in the cylinder has reached a predetermined beginning pressure threshold after the base mass of gas is injected into the cylinder;

logic to calculate an additional mass of gas beyond the base mass of gas to fill the cylinder to a predetermined beginning pressure threshold; and logic to control the injection of the additional mass of gas.

8. The medium of claim 7, wherein said logic to control the injection of a beginning mass of gas into the cylinder further comprises:

logic to monitor and record cylinder pressure, the total mass of gas injected into said cylinder, the supply pressure of the dispenser, and the ambient temperature; and logic to allow pressure equalization between the cylinder and the gas dispensing system after the injection of gas into the cylinder.

9. The medium of claim 5, wherein the logic to control the injection of the intermediate mass of gas to achieve the predetermined threshold fill percentage further comprises:

logic to open a fuel dispenser valve;

logic to monitor and record the cylinder pressure, the total gas mass injected, the fuel dispenser supply pressure, and the ambient temperature;

logic to perform a running average of the dispenser supply pressure and the temperature;

logic to close the fuel dispenser valve when the total computed gas mass to achieve the predetermined threshold fill percentage is injected into the cylinder;

logic to close the fuel dispenser valve if the cylinder pressure exceeds a predetermined safety limit; and logic to ensure pressure equalization after the fuel dispenser valve is closed.

10. The medium of claim 6, wherein the logic to control the injection of the final mass of gas to achieve the full cylinder fill state further comprises:

logic to open the fuel dispenser valve;

logic to monitor cylinder pressure, gas mass injected, fuel dispenser supply pressure, and the temperature;

logic to close the fuel dispenser valve when the total computed gas mass to achieve the full cylinder fill state is injected into the cylinder; and logic to close the fuel dispenser valve if the cylinder pressure exceeds a predetermined safety limit.

11. A computer-readable medium having a computer program for operating an automated compressed gas dispenser system used for filling compressed gas containers, the gas container having an initial pressurized state and a known limit pressure, said computer program comprising:

a) an initial pressure limit value for the gas container and a base mass value for the compressed gas to be injected into the cylinder b) a mechanism for continuously injecting a first mass of compressed gas into the gas container;

c) a mechanism for determining when said first mass of compressed gas exceeds said base mass value;

d) a mechanism for determining whether the compressed gas pressure within the gas container exceeds said initial pressure limit value in response thereto, and stopping the injection of said first mass of compressed gas into the gas container in response to exceeding said initial pressure value within the gas container; and e) a mechanism for estimating the volume of the gas container a first time in response thereto;

f) a mechanism for estimating a second mass of compressed gas required to fill the gas container to a first predetermined fill state;

g) a mechanism for estimating a third mass of compressed gas required to fill a reference gas cylinder to said first predetermined fill state in response thereto;

h) a mechanism for injecting said second mass of compressed gas into the gas container;

i) a mechanism for processing the amount of gas mass injected into the gas container from the initial state, and for processing the pressure of the compressed gas within the gas container resulting from the injection of said second mass of compressed gas into the gas container; and j) a mechanism for estimating the volume of the gas container a second time in response thereto.

12. The computer-readable medium of claim 11, further comprising:

a) a mechanism for computing a fourth mass of compressed gas that will result in a compressed gas pressure within said reference cylinder, from an initial reference cylinder state, equal to the measured pressure of the compressed gas within the gas container after said second mass of compressed gas has been injected therein;

b) a mechanism for computing a fifth mass of compressed gas be injected into the gas container for attaining a second predetermined fill state in response thereto; and c) a mechanism for injecting said fifth mass of compressed gas into the gas container.

13. The computer-readable medium of claim 11, further comprising:

a central processing unit;

an input device configured to receive data to be relayed to said central processing unit;

an output device for relaying a control signal emitted by said central processing unit; and a data bus for interconnecting said central processing unit, said computer-readable medium, said input device, and said output device.

14. The computer-readable medium of claim 13, wherein said medium is situated within a portable storage container.

15. A computer readable medium containing software for the control of the operation of an automated compressed gas dispenser system used for filling compressed gas cylinders having an initial pressure state and a known pressure limit, said software comprising:

logic to measure and store an initial cylinder pressure and ambient air temperature:

logic to compute the cylinder rating point gas density and determining the standard gas density within the cylinder;

logic to control the injection of a beginning mass of gas into the cylinder, thereby elevating the pressure inside the cylinder to a beginning pressure threshold;

logic to monitor and store the beginning mass of the gas injected into the cylinder;

logic to estimate the volume of the cylinder based on the beginning mass of the gas injected into the cylinder;

logic to determine an intermediate mass of gas necessary to fill the cylinder from the initial pressure state to a predetermined threshold fill percentage, said intermediate mass fill logic further comprising:

logic to compute beginning estimates of the cylinder water volume, initial cylinder mass, cylinder mass after the injection of the beginning mass of gas, and the cylinder rated mass;

logic to estimate the total mass of gas necessary to achieve the predetermined threshold fill percentage from the initial state of the cylinder;

logic to estimate the total gas mass necessary for a predetermined threshold fill percentage of a reference cylinder;

logic to estimate the pressure in a reference cylinder after the injection of a total gas mass injection necessary to achieve the predetermined threshold fill percentage;

logic to compare the pressure in the reference cylinder at the predetermined threshold fill percentage with the cylinder pressure limit and to adjust the total gas mass injection in said reference cylinder if the pressure in the reference cylinder exceeds the cylinder pressure limit;

logic to compute a revised total gas mass to be injected into the cylinder to achieve the predetermined threshold fill percentage based on the adjusted total gas mass injected in said reference cylinder; and logic to control the injection of the intermediate mass of gas to achieve the predetermined threshold fill percentage.

16. A computer readable medium containing software for the control of the operation of an automated compressed gas dispenser system used for filling compressed gas cylinders having an initial pressure state and a known pressure limit, said software comprising:

logic to measure and store an initial cylinder pressure and ambient air temperature;

logic to compute the cylinder rating point gas density and determining the standard gas density within the cylinder:

logic to control the injection of a beginning mass of gas into the cylinder, thereby elevating the pressure inside the cylinder to a beginning pressure threshold;

logic to monitor and store the beginning mass of the gas injected into the cylinder:

logic to estimate the volume of the cylinder based on the beginning mass of the gas injected into the cylinder;

logic to determine an intermediate mass of gas necessary to fill the cylinder from the initial pressure state to a predetermined threshold fill percentage;

logic to control the injection of the intermediate mass of as to achieve the predetermined threshold fill percentage;

logic to determine a final mass of gas necessary to fill the cylinder from the predetermined threshold fill percentage to a full cylinder fill state, said final mass fill logic further comprising:

logic to compute the cylinder water volume, initial cylinder mass, cylinder mass after the injection of the intermediate mass of gas, and the cylinder rated mass;

logic to compute an estimate of the total gas mass to be injected into the cylinder to achieve a full cylinder fill state;

logic to estimate the cylinder pressure at a full cylinder fill state; and logic to compare the estimated cylinder pressure at a full cylinder fill state with the cylinder limit pressure, and to adjust the total gas mass to be injected into the cylinder if the cylinder limit pressure is exceeded by the estimated cylinder pressure;

logic to control the injection of the final mass of gas to achieve the full cylinder fill state.

17. A computer readable medium containing software for the control of the operation of an automated compressed gas dispenser system used for filling compressed gas cylinders having an initial pressure state and a known pressure limit, said software comprising:

means for measuring and storing an initial cylinder pressure and ambient air temperature;

means for determining the cylinder rating point gas density and determining the standard gas density within the cylinder;

means for controlling the injection of a beginning mass of gas into the cylinder, thereby elevating the pressure inside the cylinder to a beginning pressure threshold;

means for monitoring and storing the beginning mass of the gas injected into the cylinder;

means for calculating a running average of a supply gas temperature and a supply gas pressure; and means for estimating the volume of the cylinder based on the beginning mass of the gas injected into the cylinder.

18. The computer readable medium of claim 17, wherein said computer readable medium is a magnetic disk.

19. The computer readable medium of claim 17, wherein said computer readable medium is a magnetic tape.

20. The computer readable medium of claim 17, wherein said computer readable medium is a compact disk (CD).

21. The medium of claim 17, said software further comprising:

means for determining an intermediate mass of gas necessary to fill the cylinder from the initial pressure state to a predetermined threshold fill percentage; and means for controlling the injection of the intermediate mass of gas to achieve the predetermined threshold fill percentage.

22. The medium of claim 21, said software further comprising:

means for determining a final mass of gas necessary to fill the cylinder from the predetermined threshold fill percentage to a full cylinder fill state; and means for controlling the injection of the final mass of gas to achieve the full cylinder fill state.

23. The medium of claim 17, wherein said means for controlling the injection of a beginning mass of gas into the cylinder further comprises:

means for controlling the injection of a base mass of gas into the cylinder;

means for determining whether the pressure in the cylinder has reached a predetermined beginning pressure threshold after the base mass of gas is injected into the cylinder;

means for calculating an additional mass of gas beyond the base mass of gas to fill the cylinder to a predetermined beginning pressure threshold; and means for controlling the injection of the additional mass of gas.

24. The medium of claim 23, wherein said means for controlling the injection of a beginning mass of gas into the cylinder further comprises:

means for monitoring and recording cylinder pressure, the total mass of gas injected into said cylinder, the supply pressure of the dispenser, and the ambient temperature; and means for allowing pressure equalization between the cylinder and the gas dispensing system after the injection of gas into the cylinder.

25. The medium of claim 21, wherein the means for determining an intermediate mass of gas necessary to fill the cylinder from the initial pressure state to a predetermined threshold fill percentage further comprises:

means for computing beginning estimates of the cylinder water volume, initial cylinder mass, cylinder mass after the injection of the beginning mass of gas, and the cylinder rated mass;

means for estimating the total mass of gas necessary to achieve the predetermined threshold fill percentage from the initial state of the cylinder;

means for estimating the total gas mass necessary for a predetermined threshold fill percentage of a reference cylinder;

means for estimating the pressure in a reference cylinder after the injection of a total gas mass injection necessary to achieve the predetermined threshold fill percentage;

means for comparing the pressure in the reference cylinder at the predetermined threshold fill percentage with the cylinder pressure limit and to adjust the total gas mass injection in said reference cylinder if the pressure in the reference cylinder exceeds the cylinder pressure limit; and means for computing a revised total gas mass to be injected into the cylinder to achieve the predetermined threshold fill percentage based on the adjusted total gas mass injected in said reference cylinder.

26. The medium of claim 21, wherein said means for controlling the injection of the intermediate mass of gas to achieve the predetermined threshold fill percentage further comprises:

means for opening a fuel dispenser valve;

means for monitoring and recording the cylinder pressure, the total gas mass injected, the fuel dispenser supply pressure, and the ambient temperature;

means for performing a running average of the dispenser supply pressure and the temperature;

means for closing the fuel dispenser valve when the total computed gas mass to achieve the predetermined threshold fill percentage is injected into the cylinder;

means for closing the fuel dispenser valve if the cylinder pressure exceeds a predetermined safety limit; and means for ensuring pressure equalization after the fuel dispenser valve is closed.

27. The medium of claim 22, wherein said means for determining a final mass of gas necessary to fill the cylinder from the predetermined threshold fill percentage to a full cylinder fill state further includes:

means for computing the cylinder water volume, initial cylinder mass, cylinder mass after the injection of the intermediate mass of gas, and the cylinder rated mass;

means for computing an estimate of the total gas mass to be injected into the cylinder to achieve a full cylinder fill state;

means for estimating the cylinder pressure at a full cylinder fill state; and means for comparing the estimated cylinder pressure at a full cylinder fill state with the cylinder limit pressure, and to adjust the total gas mass to be injected into the cylinder if the cylinder limit pressure is exceeded by the estimated cylinder pressure.

28. The medium of claim 22, wherein said means for controlling the injection of the final mass of gas to achieve the full cylinder fill state further comprises:

means for opening the fuel dispenser valve;

means for monitoring cylinder pressure, gas mass injected, fuel dispenser supply pressure, and the temperature;

means for closing the fuel dispenser valve when the total computed gas mass to achieve the full cylinder fill state is injected into the cylinder; and means for closing the fuel dispenser valve if the cylinder pressure exceeds a predetermined safety limit.

* * * * *